US010002526B1

(12) United States Patent
Dyer et al.

(10) Patent No.: US 10,002,526 B1
(45) Date of Patent: Jun. 19, 2018

(54) INTERNET-OF-THINGS SYSTEMS AND METHODS

(71) Applicant: Arrayent, Inc., Redwood City, CA (US)

(72) Inventors: Shane E. Dyer, San Francisco, CA (US); Jarrod Sinclair, San Jose, CA (US); Wo Ho Albert Au, Belmont, CA (US); Nathan Brahms, San Francisco, CA (US); Don Harschadath Wanigasekara-Mohotti, San Francisco, CA (US); Dustin H. McIntire, Thousand Oaks, CA (US); Jay Sudhakar, San Jose, CA (US)

(73) Assignee: Arrayent, Inc., Redwood City, CA (US)

( * ) Notice: Subject to any disclaimer, the term of this patent is extended or adjusted under 35 U.S.C. 154(b) by 0 days. days.

(21) Appl. No.: 15/385,570

(22) Filed: Dec. 20, 2016

(51) Int. Cl.
*G08C 17/02* (2006.01)

(52) U.S. Cl.
CPC ..... *G08C 17/02* (2013.01)

(58) Field of Classification Search
CPC .. G08C 17/02; G06N 99/005; H04L 12/2803; H04L 67/12; H04W 84/18
USPC ..... 340/12.22
See application file for complete search history.

(56) References Cited

U.S. PATENT DOCUMENTS

2014/0244834 A1* 8/2014 Guedalia ..... H04L 67/16 709/224
2015/0130957 A1* 5/2015 Berelejis ..... H04L 67/12 348/211.1
2015/0350008 A1* 12/2015 Kim ..... H04L 47/41 709/221
2015/0358777 A1* 12/2015 Gupta ..... H04L 12/2807 370/254
2016/0381143 A1* 12/2016 Malik ..... H04L 67/125 455/518
2017/0008162 A1* 1/2017 Tsubota ..... G05B 19/00
2017/0063999 A1* 3/2017 Adrangi ..... H04W 4/005
2017/0064042 A1* 3/2017 Vora ..... H04L 67/34
2017/0126834 A1* 5/2017 Fransen ..... H04L 67/303
2017/0279671 A1* 9/2017 Christopher ..... H04L 67/12

* cited by examiner

*Primary Examiner* — Hirdepal Singh
(74) *Attorney, Agent, or Firm* — The Mueller Law Office, P.C.

(57) ABSTRACT

Disclosed systems, methods and components or features thereof generally enable redesign of a legacy non-IoT device or appliance into an IoT device and incorporation into an IoT system. A communication module receives from an appliance a message with which the IoT system identifies the appliance. The communication module is provided with appliance-specific data with which it can control the appliance as an IoT device. A parser in an IoT platform uses rules and a schema to parse the appliance messages. New rules can be added for handling new communication modules for new appliances. Other features are also described.

26 Claims, 5 Drawing Sheets

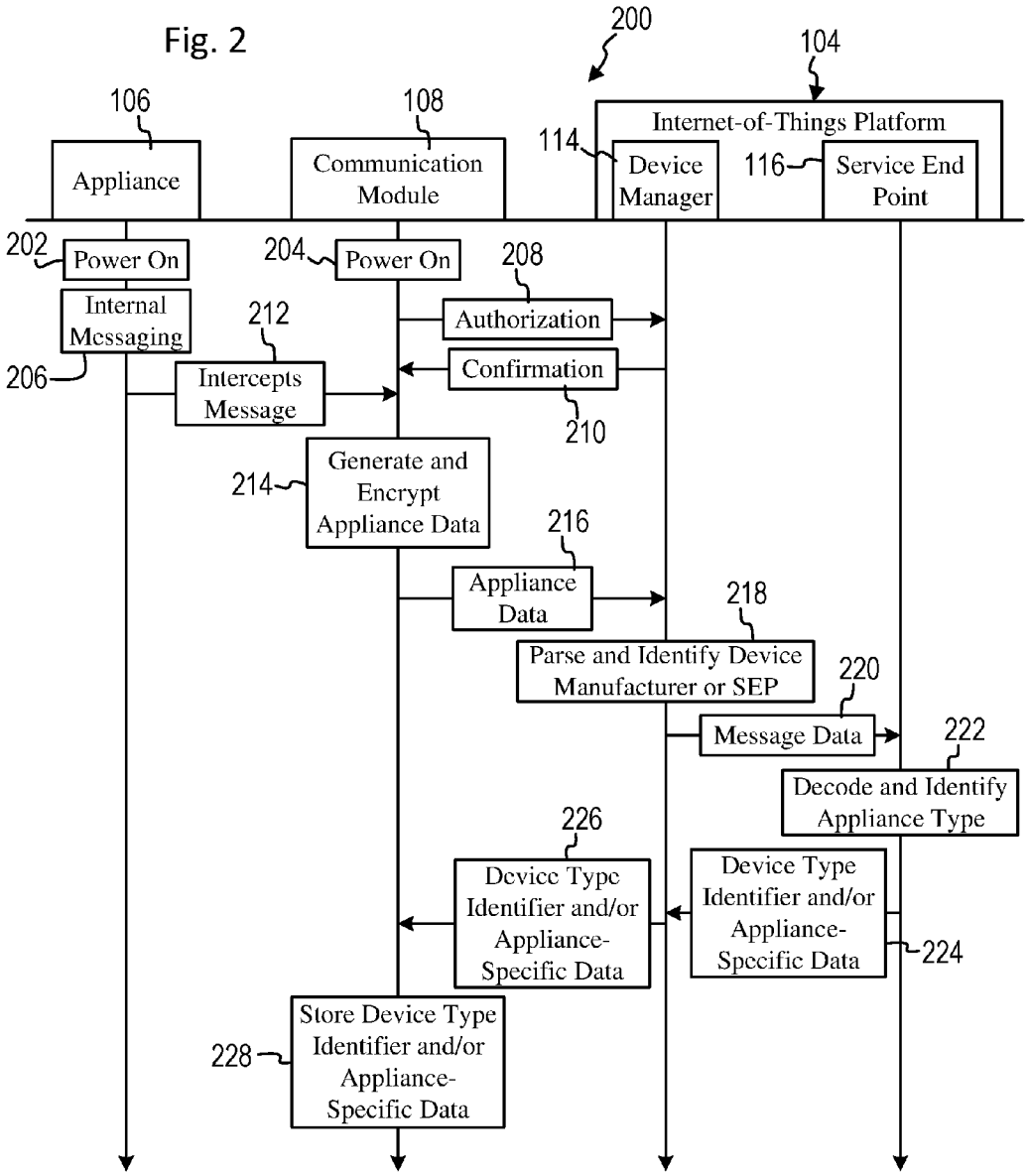
Fig. 2
200
104
106
108
Internet-of-Things Platform
114
Appliance
Communication Module
Device Manager
116
Service End Point
202
Power On
204
Power On
208
Internal Messaging
212
Authorization
206
Intercepts Message
Confirmation
210
214
Generate and Encrypt Appliance Data
216
Appliance Data
218
Parse and Identify Device Manufacturer or SEP
220
Message Data
222
Decode and Identify Appliance Type
226
Device Type Identifier and/or Appliance-Specific Data
Device Type Identifier and/or Appliance-Specific Data
224
228
Store Device Type Identifier and/or Appliance-Specific Data

INTERNET-OF-THINGS SYSTEMS AND METHODS

BACKGROUND OF THE INVENTION

Though variations on the concept do exist, the term "Internet-of-Things" (IoT) generally refers to the concept of providing a variety of different kinds of devices (e.g., electrical appliances, objects, machines, etc. that are not general purpose computing devices) with network communication capabilities, so that these devices can send and receive data that generally enables the devices to be controlled and monitored remotely through the Internet. In some cases, individual ordinary home appliances (e.g., refrigerators, dishwashers, air conditioners, water heaters, lawn sprinklers, etc.) have an embedded processor (for executing instructions to control the function of the appliances) and a network adapter, so the home owner or user can enter various settings or receive status updates through the Internet regarding the functions of the appliances when not at home. For example, while away at work or on a trip, the user can check the current temperature reading of the thermostat in the user's home and then change the thermostat's settings through an appropriate interface on the user's smart phone. On a much larger scale, a physical facilities manager of a business enterprise can adjust multiple thermostats and turn on/off the lights of entire buildings from a central remote location.

An IoT device is specifically designed to incorporate the necessary network communication capabilities in the hardware and firmware of the IoT device. When designing an entirely new IoT device, for example, the IoT functionality is taken into consideration from the beginning of the design cycle and tightly integrated into the resulting physical design or architecture of the IoT device. On the other hand, manufacturers of such devices often prefer to keep a known product that has a proven track record for reliability and performance, rather than risk potential unforeseeable problems and setbacks that can be encountered when creating an entirely new design for a product. However, when it is desired to take an existing device (that was not originally designed to be an IoT device) and turn it into an IoT device, it is typically necessary to re-architect the original design of the hardware and firmware in order to add the network communication capability and remote control response functionality that enable the IoT device to handle transmitting and receiving data through the Internet in order to operate as a fully functional IoT device. Making such changes is not always a simple straightforward process, because new components have to be added to existing integrated circuits or circuit boards, new firmware has to be provided for the embedded processor, and the altered design has to be rigorously tested to ensure that all of the new features are compatible with the existing features. In fact, it can sometimes be quite time consuming, costly and more difficult to change an existing design compared to creating an entirely new design. Yet, most device manufacturers already have a legacy non-IoT product that they would like to leverage into an IoT product.

SUMMARY OF THE INVENTION

In accordance with some embodiments, Internet-of-Things (IoT) systems, methods and components that enable a relatively quick and simple redesign of a legacy non-IoT device or appliance into an IoT device and incorporation into the IoT system, among other features, are generally described. In some embodiments, a method involves receiving, by a communication module from a data communication subsystem of an appliance, an appliance message that was transmitted from a component of the appliance through the data communication subsystem; transmitting, by the communication module to an Internet-of-Things (IoT) platform adapted to determine an identity of the appliance, appliance data based on the appliance message; and receiving, by the communication module from the IoT platform, appliance-specific data based on the identity of the appliance; wherein the communication module is capable of controlling the appliance as an IoT device only after, and not before, the receiving of the appliance-specific data.

In some embodiments, a system includes a communication module and an IoT platform. The communication module is adapted to: be communicatively coupled to an appliance that performs a function by transmitting appliance messages through a communication subsystem between components of the appliance, be communicatively coupled to a network, receive an appliance message, the appliance message being one of the appliance messages, transmit appliance data based on the appliance message through the network, receive appliance-specific data that depends on an identity of the appliance through the network, generate appliance commands based on the appliance-specific data, and control the function of the appliance by transmitting the appliance commands through the communication subsystem to the components of the appliance. The Internet-of-Things (IoT) platform is adapted to: be communicatively coupled to the network, receive the appliance data through the network from the communication module, determine the identity of the appliance based on the appliance data, and transmit the appliance-specific data through the network to the communication module.

In some embodiments, the appliance message is transmitted by a controller of the appliance to a functional component of the appliance to control a function of the appliance that does not involve the communication module. In some embodiments, the IoT platform receives the appliance data; determines the identity of the appliance based on the appliance data; and transmits (to the communication module) the appliance-specific data based on the identity of the appliance. In some embodiments, the communication module determines an initial identification of the appliance based on the appliance message; the appliance data is further based on the initial identification; and the IoT platform uses the initial identification to focus the determining of the identity. In some embodiments, after the step of determining the identity of the appliance and before the step of transmitting the appliance-specific data; the IoT platform lists the communication module as an unclaimed device with restricted operation capabilities; the IoT platform receives (from a user device) information identifying the communication module; and the IoT platform delists the communication module as the unclaimed device. In some embodiments, when the determining of the identity of the appliance; the appliance data is parsed using a rule stored in a data store to locate a desired data relative to a known location in the appliance data; and the desired data is translated according to a schema specified by the rule. In some embodiments, when determining the identity of the appliance, a device manager (of the IoT platform) determines a group of appliances in which the appliance is classified; the group is one of a plurality of groups of appliances; the device manager determines a selected service end point of the IoT platform; the selected service end point is one of a plurality of service end points; each service end point corresponds to at least one group of appliances of the plurality of groups of appliances; the selected service end point corresponds to the group of appliances in which the appliance is classified; the device manager transmits (to the selected service end point) the appliance data; and the selected service end point determines the identity of the appliance based on the appliance data. In some embodiments, the selected service end point receives (from a user device) a user device message for a selected function of the appliance; the selected service end point generates a command message instructing the communication module to cause the appliance to perform the selected function; the selected service end point transmits (to the communication module) the command message; the communication module receives the command message; the communication module generates a command based on the command message and the appliance-specific data; the communication module transmits (to the appliance) the command causing the appliance to perform the selected function; and the communication module cannot perform the step of generating the command until after performing the steps of receiving the appliance message, transmitting the appliance data, and receiving the appliance-specific data. In some embodiments, the communication module generates an appliance command based on the appliance-specific data; the appliance command controls at least one function of the appliance; and the communication module transmits (through the data communication subsystem to the component of the appliance) the appliance command. In some embodiments, the communication module performs the steps of receiving the appliance message and transmitting the appliance data every time the communication module is powered on; and every time the communication module is powered on, the communication module does not perform the steps of generating and transmitting the appliance command controlling at least one function of the appliance until after the step of receiving the appliance-specific data. In some embodiments, a service end point receives (from a user device) a command for a selected function of the appliance; at least one of: the communication module, the service end point and a microcontroller of the appliance detects that the selected function is a potentially harmful operation of the appliance; the at least one of: the communication module, the service end point and the microcontroller deletes the command. In some embodiments, the communication module receives a plurality of appliance messages transmitted through the data communication subsystem, the appliance message is one of the plurality of appliance messages; the communication module filters the plurality of appliance messages for a predetermined message type to obtain the appliance message; the communication module generates the appliance data based on the appliance message; and other received appliance messages are deleted. In some embodiments, the communication module transmits (through the data communication subsystem) a trigger appliance message that causes the component to generate and transmit the appliance message. In some embodiments, the communication module receives a plurality of appliance messages that were transmitted from at least one component of the appliance through the data communication subsystem, the appliance message is one of the plurality of appliance messages; the communication module generates (only once prior to the receiving of the appliance-specific data) the appliance data based on the appliance message; and the communication module transmits (only once prior to the receiving of the appliance-specific data) the appliance data. In some embodiments, the communication module receives a plurality of appliance messages that were transmitted from at least one component of the appliance through the data communication subsystem; the communication module generates (prior to the receiving of the appliance-specific data) a plurality of appliance data based on the plurality of appliance messages; and the communication module transmits (to the IoT platform prior to the receiving of the appliance-specific data) the plurality of appliance data. In some embodiments, the communication module receives a plurality of appliance messages that were transmitted from at least one component of the appliance through the data communication subsystem; the communication module generates (repeatedly at periodic intervals prior to the receiving of the appliance-specific data) the appliance data based on the plurality of appliance messages; and the communication module transmits (repeatedly at the periodic intervals prior to the receiving of the appliance-specific data) the appliance data. In some embodiments, the appliance is a thermostat; the component of the appliance that transmitted the appliance message is a controller of the appliance; the appliance message was transmitted from the controller to a burner switch; and the appliance message is a heat-on message that closes the burner switch to turn on a heating element.

In some embodiments, a method involves providing a non-IoT appliance that transmits appliance messages through a data communication subsystem between components of the non-IoT appliance to control operation of the non-IoT appliance; communicatively coupling a communication module to the data communication subsystem of the non-IoT appliance, the communication module being adapted to receive the appliance messages and transmit them to an IoT platform; providing a parser in the IoT platform that uses rules and a schema stored in a data store to parse other appliance messages received from other communication modules; and adding a set of rules to the data store, the set of rules enabling the parser 1) to parse the appliance messages transmitted from the communication module, 2) to determine an identity of the non-IoT appliance based on the parsed appliance messages, and 3) to transmit appliance-specific data based on the identity to the communication module; wherein the appliance-specific data enables the communication module to control the non-IoT appliance as an IoT device.

In some embodiments, the data communication subsystem is a data bus; the non-IoT appliance includes a microcontroller communicatively coupled to the data bus to transmit the appliance messages on the data bus; and the communication module is communicatively coupled to the data bus to monitor the appliance messages on the data bus. In some embodiments, the communication module and the IoT platform are adapted to perform an identification process every time the communication module is powered on; the identification process 1) determines the identity of the non-IoT appliance, and 2) transmits the appliance-specific data based on the identity to the communication module; and the communication module cannot control the non-IoT appliance after being powered on and prior to receiving the appliance-specific data.

In some embodiments, a method involves providing an IoT platform that is communicatively coupled to a plurality of communication modules that control a plurality of IoT devices; providing a parser in the IoT platform that uses rules and a schema stored in a data store to parse appliance messages received from the plurality of communication modules and to generate commands that control the communication modules; and adding a set of rules to the data store, the set of rules enabling the parser 1) to parse new appliance messages transmitted from a new communication module that controls a new IoT device, and 2) to generate new commands that control the new communication module.

BRIEF DESCRIPTION OF THE DRAWINGS

FIG. 2 illustrates a simplified workflow diagram for example functions of various components of the IoT system shown in FIG. 1, in accordance with some embodiments.

DETAILED DESCRIPTION OF THE EMBODIMENTS

Reference now will be made in detail to embodiments of the disclosed invention, one or more examples of which are illustrated in the accompanying drawings. Each example is provided by way of explanation of the present technology, not as a limitation of the present technology. In fact, it will be apparent to those skilled in the art that modifications and variations can be made in the present technology without departing from the scope thereof. For instance, features illustrated or described as part of one embodiment may be used with another embodiment to yield a still further embodiment. Thus, it is intended that the present subject matter covers all such modifications and variations within the scope of the appended claims and their equivalents.

A conventionally designed IoT device of any particular type, whether an entirely new IoT device or a legacy non-IoT device or appliance that has been converted to an IoT device, as mentioned above, is a fully functioning IoT device of that particular type at the end of its manufacturing process or upon being sold to a customer or user. Thus, a conventional IoT device is designed and manufactured with the "intelligence" needed to begin communicating with a conventional IoT platform and operating as the particular type of IoT device or appliance that it is as soon as it is turned on. An improved IoT device incorporating embodiments of the present invention, on the other hand, is not designed and manufactured with such fully functioning capability to operate as its particular type of IoT device or appliance as soon as it is turned on. Instead, in order to simplify, and reduce the time and cost of, the redesign from legacy non-IoT device to IoT device, the improved IoT device is provided with the capability of monitoring and intercepting internal messages of the legacy appliance portion thereof (in the manufacturer's legacy protocol) and transmitting data based on those appliance messages to an improved IoT platform incorporating embodiments of the present invention. Based on this data, the improved IoT platform identifies the particular type (e.g., thermostat, refrigerator, dishwasher, air conditioner, water heater, lawn sprinkler, lighting system, coffeemaker, garage door opener, air purifier, vacuum cleaner, air humidifier, industrial programmable logic controller, vehicle electronic control unit, water softener, etc.) of the improved IoT device. After identifying the particular type of the improved IoT device, the improved IoT platform provides the improved IoT device with the additional capability to further communicate with the improved IoT platform and operate as the particular type of IoT device or appliance that it is. Various advantages of this system and technique over a conventional IoT device and system will be described below or will become apparent in light of the following disclosure.

Figure 1:
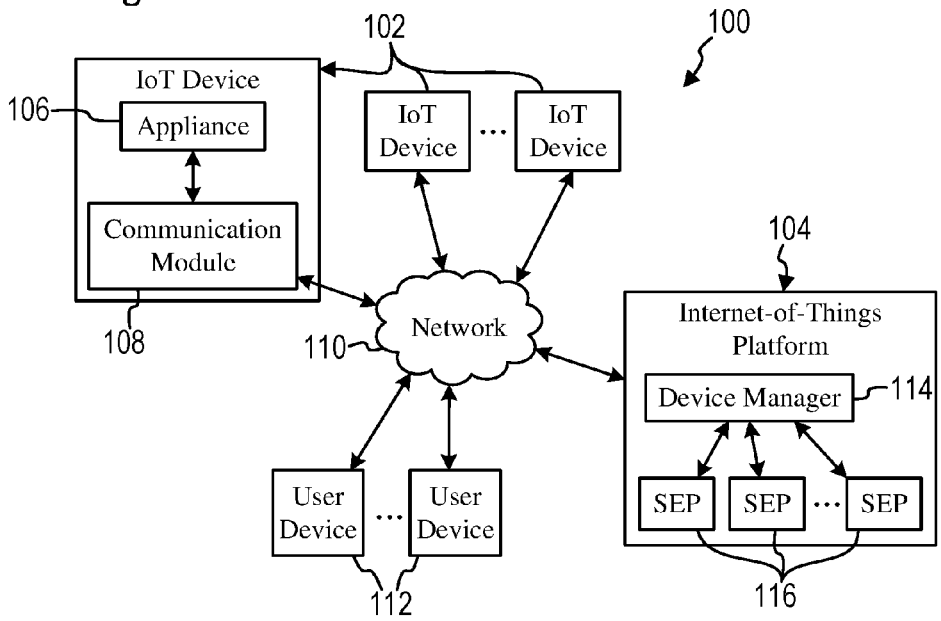
FIG. 1 illustrates a simplified schematic diagram of an example IoT system in accordance with some embodiments.

An example Internet-of-Things (IoT) system 100 that enables a relatively quick and simple redesign of a legacy non-IoT device or appliance into an IoT device and incorporation into the IoT system 100 is shown in FIG. 1, in accordance with some embodiments. The IoT system 100 generally includes a variety of different IoT devices 102 and an IoT platform 104. The IoT devices 102 generally include a device, electrical appliance, object, machine, etc. (referred to herein as an "appliance") 106 and a communication module 108. The IoT devices 102 (through the communication module 108) and the IoT platform 104 communicate through a network 110. Additionally, user devices 112 of the owners or users of the IoT devices 102 also communicate through the network 110 with the IoT platform 104 and the IoT devices 102.

In some embodiments, the appliance 106 generally represents the housing or structural components of the IoT device 102, as well as the components for performing the appliance-specific functions of the IoT device 102, e.g., a pump for pumping water in a dishwasher, a heat exchanger for heating or cooling air in an air conditioner, a heating element for heating water in a water heater, a burner switch of a thermostat for turning on a heating element of an air heater, etc. Additionally, since many types of legacy non-IoT devices (i.e., so called "smart" appliances) also include a microcontroller or processor, electronic memory, a data storage device, a data communication subsystem, a user input/output (I/O) interface, and/or other electronic components for controlling the appliance-specific functions, the appliance 106 also represents these components.

The microcontroller and the other electronic components of the appliance 106 are generally communicatively coupled to each other through the data communication subsystem, so that the microcontroller generally controls the other electronic components (and thus the appliance-specific functions) by transmitting and receiving data packets (referred to herein as "appliance messages") to and from the other electronic components. In some embodiments, the appliance messages are formatted in the manufacturer's legacy protocol used for the legacy non-IoT device. The appliance messages generally include various headers or addresses used by the various components to determine whether they are the intended recipients of the appliance messages. The appliance messages also generally include various types of data (e.g., commands and status information) used by the recipients thereof to perform their specific functions that depend on the type of the appliance and the capabilities thereof, e.g., turning on/off power to various components (such as a water pump, a heating element, a light display, a coolant compressor, etc.), receiving commands from (or presenting user feedback to) the user through the user I/O interface, etc. In some embodiments in which the IoT device 102 has been adapted or converted from a legacy non-IoT device, the appliance messages transmitted within the IoT device 102 are the same as, or similar to, the appliance messages transmitted within the legacy non-IoT device.

In some embodiments, the communication module 108 generally represents a network interface, an appliance interface, a microcontroller, an electronic memory, firmware and data, among other potential components for communicating with the IoT platform 104 and the appliance 106, processing data and instructions received from both, and generating commands to control the appliance 106. In some embodiments in which the IoT device 102 has been adapted or converted from a legacy non-IoT device, the appliance 106 may be considered to represent components that correspond to some or all of the components of the legacy non-IoT device, including hardware and firmware. In this case, therefore, the communication module 108 generally represents components that were added to the legacy non-IoT device to convert it into the IoT device 102.

In some embodiments, since the appliance 106 and the communication module 108 include some components that are similar to each other (e.g., a microcontroller and electronic memory), the appliance 106 and the communication module 108 can both be designed to use the same such components. For example, firmware for the communication module 108 can be loaded into the electronic memory and executed by the microcontroller of the appliance 106 to perform the functions of the communication module 108. In other words, even though the appliance 106 and the communication module 108 are shown as separate blocks in FIG. 1, some of their actual physical components may overlap or be shared in some embodiments.

In some embodiments, the communication module 108 is communicatively coupled to the appliance 106, e.g., through its appliance interface to the data communication subsystem of the appliance 106. Through this connection, the communication module 108 monitors and intercepts some or all of the appliance messages that are transmitted between the various components of the appliance 106 and transmits commands to the microcontroller and/or other components of the appliance 106. In some embodiments in which the communication module 108 includes firmware loaded into the electronic memory and executed by the microcontroller of the appliance 106 (instead of the communication module 108 having its own separate microcontroller), the firmware for the communication module 108 is adapted to intercept the appliance messages transmitted and received by the microcontroller of the appliance 106 and transmits commands to the microcontroller and/or to other components of the appliance 106 through the data communication subsystem. Additionally, the communication module 108 is communicatively coupled to the network 110, e.g., through its network interface, with either a wired or wireless network adapter. Through this connection, the communication module 108 transmits and receives network communication packets to and from the IoT platform 104 through the network 110. In this manner of intercepting the appliance messages, transmitting its own appliance commands to components of the appliance 106, and communicating with the IoT platform 104, the communication module 108 is adapted to perform a portion of the technique (mentioned above, and described in more detail below) to identify the type of the appliance 106 and to receive the capability to control the operation of the appliance 106 as a fully functional IoT device.

In some embodiments, the network 110 generally represents the Internet, but may also include various cell phone networks, wired/wireless LANs/WANs, and other appropriate networking systems or environments through which the IoT devices 102, the IoT platform 104 and the user devices 112 can communicate in addition to, or instead of, the Internet. Although the IoT devices 102 and the IoT platform 104 communicate through the network 110, the network 110 is not necessarily considered to be part of the IoT system 100.

The user devices 112 generally represent any appropriate computerized devices (e.g., desktop computers, notebook computers, tablet computers, digital assistants, smart phones, smart watches, etc.) that the owners or operators of the IoT devices 102 can use to communicate with the IoT platform 104 and/or the IoT devices 102. With an application (e.g., program, user interface, web application/applet, etc.) operating on the user device 112, the user is able to monitor and/or control the user's IoT devices 102 after they have been identified and the corresponding communication device 108 has received the capability to control the operation of the appliance 106 as a fully functional IoT device. Although the user devices 112 are used to communicate with the IoT devices 102 and the IoT platform 104, the user devices 112, themselves, not necessarily considered to be part of the IoT system 100. However, the application operating on the user devices 112 to communicate with the IoT devices 102 and the IoT platform 104 is generally considered to be part of the IoT system 100.

The IoT platform 104 generally represents any appropriate number and combination of computerized devices from one stand-alone computer device up to multiple distributed-computing devices, such as in a server farm or a cloud computing system. The IoT platform 104 also generally represents executable programs, and data for performing the functions described herein. In some embodiments, the IoT platform 104 is instantiated in an API in a cloud-based computing system, in which case the actual physical devices represented by the IoT platform 104 may be of an indeterminate number, type and combination and may be shared with other users of the cloud-based computing system.

The IoT platform 104 generally includes at least one device manager 114 and several service end points (SEPs) 116. Like the IoT platform 104, the device manager 114 and the service end points 116 generally represent any appropriate number and combination of computerized devices (from a single computer device up to a portion of a cloud-based computing system), executable programs, and data for performing the functions described herein.

In general, the communication module 108 communicates with the IoT platform 104 through the network 110 by transmitting and receiving network communication packets to and from the device manager 114 and at least one of the service end points 116. In some embodiments, communication messages between the communication module 108 and the service end points 116 are passed through the device manager 114; whereas, in some embodiments, the messages between the communication module 108 and the service end points 116 bypass the device manager 114.

FIG. 2 shows a simplified workflow diagram 200 for example functions of the appliance 106, the communication module 108, and the IoT platform 104 (i.e., the device manager 114 and at least one of the service end points 116), including an identification process to identify the type of the appliance 106 and establish the capability of the communication module 108 to control the appliance 106 as an IoT device, in accordance with some embodiments. For ease of illustration and description, the illustrated embodiment is provided as just one example for the workflow functions, and some functions are either not shown or are combined with other functions. Some alternative embodiments with other example workflow functions will also be described, and still other embodiments will become apparent from a full understanding of the disclosure herein. The exact combination and order of functions in the workflow diagram 200 are, thus, provided for explanatory purposes only. Other embodiments will have other functions or combinations of functions.

When the IoT device 102 is turned on, the appliance 106 and the communication module 108 are powered up at 202 and 204, respectively. Upon being powered up (at 202), the appliance 106 generally begins to operate according to its capabilities as a legacy non-IoT device, e.g., it begins the internal messaging (at 206) through its data communication subsystem that initializes its various components. Additionally, in the illustrated embodiment, upon being powered up (at 204) and initializing its components, the communication module 108 performs an authorization process before it begins the identification process (to identify the type of the appliance 106 and receive and store any programs or data that are specific to the particular type of the appliance 106, which enable the capability to control the appliance 106 as an IoT device). (Alternatively, the authorization process is combined with the identification process, as described below.) Thus, the communication module 108 generates an authorization message, which it transmits (at 208) to the device manager 114. To do so, the communication module 108 forms a network communication packet (containing the authorization message) with headers to direct the authorization message through the network 110 to the device manager 114 using a stored known address (e.g., an Internet Protocol (IP) address, a Domain Name Server (DNS) address, etc.) for the device manager 114. The authorization message includes data (which may be encrypted) that at a minimum identifies the communication module 108. The device manager 114 confirms whether the communication module 108 is authorized to communicate with the IoT platform 104, e.g., by traversing through a data store to find a match with the communication module identity data. If the device manager 114 confirms authorization, then it transmits (at 210) a "confirmation" message to the communication module 108, thereby authorizing, registering or verifying the communication module 108, or establishing a communication session with the communication module 108. If the device manager 114 does not confirm authorization, then it transmits a "denied" message (or no message) and then blocks the communication module 108 from further communication with the IoT platform 104.

In some embodiments, the authorization process (described above) is combined with the identification process by transmitting the authorization message with appliance data (or the first such appliance data) transmitted for the identification process, as described below. In this case, the device manager 114 performs its portion of the authorization process before processing the appliance data for the identification process, as also described below.

In some embodiments, the communication module 108 does not maintain a persistent state from a previous power-on period, so the communication module 108 performs the authorization process every time it is powered on. In other embodiments, the communication module 108 does maintain such a persistent state (e.g., by storing authorization data in a non-volatile memory or setting an "authorized" bit in a register), and the IoT platform 104 allows the communication module 108 to remain authorized when powered off, so the communication module 108 performs the authorization process only once at the first time it is powered up or only when the non-volatile memory contents or the register bits have been lost or corrupted.

When the communication module 108 receives the confirmation message, in the illustrated embodiment, it begins the identification process to identify the type of the appliance 106 and receive the capability to control the appliance 106 as an IoT device. (In some embodiments in which the authorization process is combined with the identification process, the communication module 108 begins the identification process, instead of the authorization process, upon being powered up.) To do so, the communication module 108 snoops, "listens" to, or polls the appliance messages being transmitted through the data communication subsystem of the appliance 106. In general, the communication module 108 intercepts (at 212) at least one of the appliance messages, generates and encrypts (at 214) the appliance data based on the intercepted appliance message(s) (or at least one frame of data extracted from the intercepted appliance message(s)), and transmits (at 216) the network communication packet containing the appliance data to the device manager 114. In some embodiments, the communication module 108 has no capability or intelligence to identify the type of the appliance 106, so the communication module 108 makes no determination or decision for which of the appliance messages to intercept and use for the appliance data. In this case, the communication module 108 is considered to be a "thin client." In other embodiments, the communication module 108 has some capability or intelligence to identify (or assist in the identification of) the type of the appliance 106, so the communication module 108 makes a determination or decision for which of the appliance messages to use for the appliance data. In this case, the communication module 108 is considered to be a "thick client." Additionally, some aspects or features of the communication module 108 can be considered "thin," while other aspects or features can be considered "thick."

In some embodiments, e.g., in some thin-client embodiments, the appliance data includes an unmodified (except for encryption) copy or version of the intercepted appliance message(s). In some embodiments, e.g., in some thick-client embodiments, although the communication module 108 does not have any instructions or data that are specific to the identity of the appliance 106 at this point, the communication module 108 nevertheless includes a filtering capability with rules to filter or parse through the intercepted appliance message(s) to find a predetermined message type or a desired relevant subset of the data in the intercepted appliance message(s), e.g., message header data, command data, etc. In this case, the appliance data includes the predetermined message type or the desired relevant subset data in a filtered version of the intercepted appliance message(s). In some embodiments, the communication module 108 decodes or translates the desired relevant subset data into a particular format for use in the IoT system 100.

In some cases, it is possible that not all of the appliance messages generated within the appliance 106 can be used for the identification process. Therefore, in some embodiments, e.g., in some thick-client embodiments, the communication module 108 includes a filtering or polling capability with rules to intercept and parse through the data of a number of the appliance messages to find or obtain one or more predetermined or specific message types, e.g., at least one appliance message that is (or is likely to be) an identifying message, which contains a string or combination of data that is specific to the appliance 106, i.e., data that is known to occur within appliances of the type of the appliance 106, such as appliance message headers and control, command or status codes. In this case, the communication module 108 generates (at 214) the appliance data from the data of one or more such identifying messages and discards or deletes other intercepted appliance messages from its electronic memory.

In some embodiments, e.g., in some thick-client embodiments, although the communication module 108 does not have any instructions or data that are specific to the identity of the appliance 106 at this point, many types of appliances use the same or similar known data (e.g., formats, headers, command codes, data structures, etc.) for some of the appliance messages. To take advantage of this fact, the communication module 108 includes a capability to generate some types of appliance messages ("trigger appliance message") that can trigger or cause one or more of the components of the appliance 106 to generate an appliance message ("response appliance message") that has such known data. The trigger and response appliance messages should be relatively benign from the point of view of the appliance 106, so that the trigger appliance message cannot cause any component of the appliance 106 to perform a function that might be inappropriate at this point, e.g., turning on/off a water pump, transmitting confidential information, etc. The communication module 108 transmits its trigger appliance messages (through the data communication subsystem of the appliance 106 to a component thereof) and afterwards intercepts and filters (or looks for) the response appliance messages (that potentially include the known data) that the recipient component of the appliance 106 generates in response. For example, the response appliance message may be one of the next appliance messages to appear on the data communication subsystem (so the communication module 108 simply intercepts the next predetermined number of appliance messages that appear within a predetermined time period after transmitting the trigger appliance message) or it may be detected by the communication module 108 by having some form of the known data therein. In other words, the communication module 108 has an initial capability to be a full participant of the data communication subsystem, instead of just a passive listener, even though it cannot control actual operation of the appliance 106 at this point. However, from the point of view of the component that generated the appliance message in response to the appliance message from the communication module 108, the response appliance message is not directed to the communication module 108, but is directed to another component of the appliance 106 in accordance with the legacy functions of these components of the appliance 106. In this case, the communication module 108 generates (at 214) the appliance data from the data of one or more responses (to one or more of the appliance messages generated by the communication module 108) or analyzes the one or more responses to determine a relationship between them and generates the appliance data based on the analysis results.

In some embodiments, e.g., in some thick-client embodiments, the communication module 108 includes a capability to generate or determine an initial identification of the type of the appliance 106 based on the filtered, parsed and/or analyzed data of some of the appliance messages. In this case, the appliance data includes the initial identification along with additional data based on the appliance messages. (With the initial identification, the subsequent operation of the device manager 114 and/or the service end point 116 can be shortened or more efficient.)

On the other hand, in some embodiments, e.g., in some thin-client embodiments, the communication module 108 does not include any capability to filter the appliance messages for specific message types or data, so the communication module 108 indiscriminately intercepts any appliance message(s) with which to generate (at 214) the appliance data. In this case, the appliance data is not tailored (as it is for the various thick-client embodiments) to assist the IoT platform 104 (e.g., the device manager 114 or the service end point 116 or both) in identifying the type of the appliance 106. For example, in some embodiments, the communication module 108 uses every appliance message that it intercepts and repeatedly generates and transmits appliance data until it receives a "success" response from the IoT platform 104, a period of time expires, or the communication module 108 is turned off. In other embodiments, instead of using every intercepted appliance message, the communication module 108 simply uses the first appliance message that it intercepts, and if that intercepted appliance message does not result in a successful identification process, then the communication module 108 repeats 212-216 with a different intercepted appliance message. In some embodiments, the communication module 108 does not repeat 212-216 unless it receives a "failure" response from the IoT platform 104. In some embodiments, the communication module 108 repeats 212-216 after a predetermined period of time expires, unless it receives the success response from the IoT platform 104. In other embodiments, the communication module 108 uses the first N number of appliance messages that it intercepts, instead of just one at a time. In this case, the communication module 108 includes data from all of these intercepted appliance messages to generate a single instance of the appliance data or generates and transmits multiple instances of the appliance data, e.g., one for each intercepted appliance message. Again, the communication module 108 repeats 212-216 with the next N number of intercepted appliance messages if it receives the failure response or after a predetermined period of time if it does not receive the success response. In some embodiments, the communication module 108 stops the identification process if the success response is not received within a maximum time period and does not restart the identification process unless it (or the entire the IoT device 102) is turned off and then back on, or unless it is manually reset, by the user.

In some embodiments, the communication module 108 does not maintain a persistent state from a previous power-on period, i.e., it does not store any programs or data that are specific to the particular type of the appliance 106 in a non-volatile memory, so the communication module 108 begins to perform the identification process (e.g., with 212-216) every time it is powered on. In other embodiments, the communication module 108 does maintain such a persistent state, e.g., by storing various appliance-specific programs and data in a non-volatile memory, so the communication module 108 begins to perform the identification process (e.g., with 212-216) only once at the first time it is powered up or only when the non-volatile memory contents have been lost or corrupted.

In some embodiments, the IoT device 102 includes a power switch or button for turning it on and off, but is also typically always plugged into a power source, such as a wall electrical outlet. In some embodiments, therefore, it is possible to continue to provide power to the communication module 108, as well as to some components of the appliance 106, even when the power switch is turned off, and the IoT device 102 appears outwardly to be powered off. Thus, as long as the IoT device 102 is plugged into the power source, the communication module 108 remains powered on, so the next time the user activates the power switch, the communication module 108 does not necessarily have to begin the authorization and identification processes. There are many types of appliances (e.g., air conditioners, water heaters, dishwashers, etc.) that typically remain plugged into the power source, even when they appear to be turned off, so the authorization and identification processes are not necessarily performed very often.

When the device manager 114 receives the appliance data, it parses (at 218) the appliance data to identify the manufacturer of the IoT device 102 or the service end point 116 that is intended to handle or service communications received from or intended for the IoT device 102. In some embodiments, some of the service end points 116 handle communications with the communication modules for just one type of appliance. In other embodiments, however, some of the service end points 116 handle communications with the communication modules for a plurality of different types of appliances.

In some embodiments, since manufacturers of the types of appliances described herein typically have several product lines of appliances (which may be marketed under one or more brand names), some of the service end points 116 are adapted to handle or service communications with appliances in multiple, or all of the, product lines for at least one manufacturer. In some embodiments, the appliances of a given manufacturer are considered (for purposes of the present disclosure) to be classified into one or more groups of related appliances. When there are multiple manufacturers, then there is typically a plurality of such groups. In some embodiments, therefore, each service end point 116 is considered to correspond to at least one group of related appliances and is adapted to respond to the appliance data received from the communication modules for the appliances classified in that group.

Even though a single manufacturer may produce more than one type of appliance, there is often some overlap or similarity in some of the components used in each of the appliances. For example, a given manufacturer often uses the same microcontroller, electronic memory, and/or data communication subsystem (or similar such components provided by the same supplier) across multiple product lines. In this case, expertise gained when working with such components in one appliance can be leveraged when working with the same components in another appliance. Additionally, some hardware and firmware portions of a design for one appliance can be used in the design of a different appliance. In some embodiments, appliances that contain the same or similar hardware and/or firmware are considered to be classified in the same group of related appliances.

As a result of these design similarities between different appliances of the same manufacturer, the appliance messages transmitted between components of one appliance typically have some similarities with the appliance messages transmitted between components of another appliance in the same group. For example, the same or similar message headers and/or control, command or status codes, or other message data, are often used in the appliance messages for different appliances in the same group. Therefore, when the device manager 114 parses (at 218) the appliance data, it extracts data for this type of information and then traverses a data store to search for a match based on this information, thereby determining which of the plurality of groups of related appliances is the group in which the appliance 106 is classified. A match is, thus, indicative of the service end point 116 that corresponds to the type of the appliance 106. The device manager 114, thus, determines from the group which of the plurality of service end points 116 is the correct service end point 116 adapted to respond to the appliance data. In some embodiments, e.g., in some thick-client embodiments, since the appliance data is tailored to assist in identifying the type of the appliance 106, the determining of the correct service end point 116 is performed more quickly than it is for thin-client embodiments. In some embodiments, e.g., in some thick-client embodiments, the device manager 114 uses the initial identification of the type of the appliance 106 (that was generated by the communication manager 108) to focus the traversal of the data store to search for a match, thereby determining whether the initial identification is correct (finding a match) or wrong (not finding a match). A correct initial identification thus further speeds up the determining of the correct service end point 116. (In some embodiments, when the device manager 114 determines which service end point 116 corresponds to the type of the appliance 106, the device manager 114 stores an identifier for the communication module 108 and an identifier for the service end point 116 in a data store, so that future attempts by the communication module 108 to initiate the identification process can be short-circuited or sped-up by simply looking up the appropriate service end point 116 in the data store.) In some embodiments, a failure to find a match results in the device manager 114 transmitting the failure response (mentioned above) back to the communication module 108 at this point. On the other hand, success in finding a match at this point does not yet necessarily indicate success in identifying the type of the appliance 106, because a given service end point 116 may be capable of servicing multiple different types of appliances. Upon finding a match, therefore, the switch 114 generates data in another message (which includes some or all of the appliance data) and transmits (at 220) this message data to the indicated service end point 116.

In some embodiments, the service end point 116 includes a parser with which it parses the data that it receives, which includes some or all of the original appliance data transmitted (at 216) by the communication module 108. The service end point 116 also includes a data store containing rules and a schema with which the parser can translate received data in order to service the IoT devices 102 that are in its group of related appliances, i.e., for normal operation of the IoT devices 102, some of which is described below with reference to FIG. 3.

In some embodiments, the data store information defines a message format, hierarchical arrangements for IoT device data, and relationships between IoT device data, so that the parser can be a generalized parsing solution or rule engine operating outside the specific application thereof, yet performing the specific application by using the data store information. Thus, the parser does not have to be compiled for each specific application, as does a conventional parser, because the rules can simply be updated in the data store when a new appliance or type of appliance is added to the IoT system 100, and the parser simply analyzes the appliance data with the available rules. In an example, one type of rule causes the parser to search for a particular sequence (e.g., a marker) in a string of bits or data, and when the parser finds the particular sequence, the rule causes the parser to read and translate another specific string of bits or data (located within the first string; or appliance data at a known point relative to the first string, e.g., at a relative offset), because the first string is an indication that the second string is expected to have significant or recognizable data. The example rule also includes a schema that specifies how to translate the second string of bits or data. Additionally, the schema can be changed (e.g., changing which string of bits to read for the translation) without having to change the parser, so that new capabilities can be supported without recompiling the parser. This capability of being able to quickly and easily change the rules (e.g., add a new set of rules to the data store) for the parser enhances the overall ability of the IoT system 100 to quickly turn an additional legacy non-IoT device or appliance into an IoT device, so that another appliance or type of appliance can be supported.

With this data store information, the service end point 116 (at 222) parses and decodes the received data during the identification process to determine the identity (or the particular type) of the appliance 106 communicatively coupled to the communication module 108 from which the data was received. In some embodiments, therefore, whereas the device manager 114 determines the brand name, the service end point 116 determines the specific product line, of the IoT device 102. In some embodiments, e.g., in some thick-client embodiments, since the appliance data is tailored to assist in identifying the type of the appliance 106, the determining of the identity of the appliance 106 is performed more quickly than it is for thin-client embodiments. In some embodiments, e.g., in some thick-client embodiments, the service end point 116 uses the initial identification of the type of the appliance 106 (that was generated by the communication manager 108) to focus the parsing and decoding of the received data (and determining of the identity of the appliance 106), thereby confirming that the initial identification is correct or determining that it is wrong. A correct initial identification thus further speeds up the determining of the identity of the appliance 106.

In some embodiments, when the service end point 116 successfully determines the identity or type of the appliance 106, it selects certain appliance-specific data and transmits (at 224) the appliance-specific data to the device manager 114. The device manager 114 then transmits (at 226) the appliance-specific data through the network 110 to the communication module 108. Alternatively, the service end point 116 bypasses the device manager 114 and transmits the appliance-specific data through the network 110 to the communication module 108. In some embodiments, the service end point 116 transmits (at 224) the identity or type (e.g., a device type identifier) to the device manager 114, and the device manager 114 selects the appliance-specific data (based on the device type identifier) and transmits (at 226) it to the communication module 108.

The appliance-specific data generally includes the device type identifier, filtering or polling instructions or data, command codes/data, executable program instructions, and/or other types of data or instructions (for the specific type of appliance that the appliance 106 has been determined to be) that are used by the communication module 108 to control the appliance 106 (i.e., its components) as a fully functional IoT device. In some embodiments, e.g., in some thick-client embodiments, therefore, the appliance-specific data includes a complete set of instructions and/or data for the communication module 108 to control the appliance 106 with a minimal amount of communication with, or assistance by, the service end point 116, such that most of the "intelligence" for controlling the appliance 106 is within the communication module 108. In other embodiments, e.g., in some thin-client embodiments, the appliance-specific data includes a relatively limited or minimal set of instructions and/or data for the communication module 108 to control the appliance 106 with a greater reliance on communications with the service end point 116, such that most of the "intelligence" for controlling the appliance 106 is within the service end point 116. In some embodiments, the appliance-specific data includes an identifier or address (e.g., IP address, DNS address, etc.) for the service end point 116, so that the communication module 108 can direct subsequent appliance data to the correct service end point 116.

In some embodiments, when the service end point 116 is unable to determine the identity or type of the appliance 106, it transmits the failure response back to the communication module 108, e.g., through the device manager 114 or bypassing it. On the other hand, in some embodiments, when the service end point 116 successfully determines the identity or type of the appliance 106, it transmits the success response back to the communication module 108. In some embodiments, the success response is the device type identifier or the appliance-specific data, rather than a separate, distinct message.

When the communication module 108 receives the device type identifier and/or the appliance-specific data, it stores (at 228) this information in its electronic memory and/or reconfigures itself to operate with this information. At this point, but not before, the communication module 108 is capable of controlling the appliance 106 as a fully functioning IoT device. The communication module 108, thus, generates appliance commands by processing the appliance-specific data (e.g., the filtering instructions, executable program instructions, etc.) and communicating with the IoT platform 104 (e.g., the selected service end point 116). The communication module 108 then transmits the appliance commands to the components of the appliance 106 to control the operation of the appliance 106.

In some embodiments, each IoT device 102 (or its communication module 108) is claimed by, or paired with, a user or business entity (or one or more of the user devices 112 owned or controlled by the user or business entity). Data that links the users and the IoT devices 102 for each pairing is maintained in the data store of the IoT platform 104 (e.g., of the device manager 114 or the service end point 116 or both). This data is generated, received and stored when the user or buyer of the IoT device 102 registers or activates the IoT device 102 with the IoT platform 104, e.g., in a device registration process. For example, upon purchasing the IoT device 102, the buyer uses one of the user devices 112 to transmit to the IoT platform 104 information identifying both the IoT device 102 and the user (or the user device 112). Additionally, the IoT platform 104 can receive an indication that the user has accepted an end user license agreement. Examples for the identifying information for the IoT device 102 include a serial number, a device code, a model number, a registration code, or other appropriate numeric or alphanumeric data obtained by the user from the IoT device 102, its documentation, or the manufacturer/seller. Examples for the identifying information for the user include a user account number, a username, a password, a phone number, a serial number of the user device 112, a unique device identifier (UDID) of the user device 112, etc. In some embodiments, the identifying information is received from the user or the user device 112 through a web-based registration form (e.g., hosted by the device manager 114) or a user device application. In some embodiments, the device manager 114 then maintains the received identification information in its data store, e.g., as a dynamically defined mapping of IoT devices 102 to users, customers, and/or user devices 112. In some embodiments, the device manager 114 determines which of the service end points 116 corresponds to the IoT device 102 and forwards the identification information to be maintained in the data store of that service end point 116.

Upon receiving the identification information (and confirming that it is correct data) by the IoT platform 104, the IoT device 102 is considered to be claimed, registered or activated. Additionally, the user can further provide configuration information to configure the operation of the communication module 108 and the IoT device 102 and/or to configure the manner in which the service end point 116 controls or communicates with the communication module 108. For example, the user (through the user device 112) can specify the type or level of information that the communication module 108 shares with the IoT platform 104 and/or the types of commands that the service end point 116 can transmit to the communication module 108, among other types of configuration parameters that depend on the type of the IoT device 102. However, until the communication module 108 of the IoT device 102 performs the identification process, any commands requested by the user device 112 for controlling the IoT device 102 cannot be generated and/or transmitted to the communication module 108.

In some embodiments, it is possible for the communication module 108 to be communicatively coupled to the network 110, be powered on, and complete the identification process before the user has completed the device registration process. In this case, the device manager 114 and the service end point 116 generally perform as described above up to 222, but then list the communication module 108 (or the IoT device 102) as an unclaimed, unregistered, or inactivated device within their data store, e.g., as if the communication module 108 is in a sort of "waiting room." Additionally, restrictions are placed on the operation capabilities that the communication module 108 and/or the IoT platform 104 can perform, since there is less need to perform all IoT device tasks if there is no user device 112 to operate in conjunction with. In some embodiments, for example, when the communication module 108 is unclaimed, the service end point 116 provides it with instructions to curtail its operation, e.g., to stop intercepting subsequent appliance messages and transmitting further appliance data (except for periodic polling messages) to the IoT platform 104. In some embodiments, the service end point 116 sends firmware updates to the communication module 108 for the authorization and identification processes, but does not transmit the entire appliance-specific data for full IoT device capabilities to the communication module 108. In some embodiments, the service end point 116 transmits the entire appliance-specific data, but provides the communication module 108 with the instructions to curtail its operation. In some embodiments, the service end point 116 transmits instructions or configuration data to the communication module 108 that define a limited set of key characteristics or data that the communication module 108 can transmit to the IoT platform 104, so that the IoT platform 104 does not receive information that the eventual user might not want the IoT platform 104 to have. In some embodiments, although the communication module 108 is not restricted in its operation or the type of data that it can transmit to the IoT platform 104, the device manager 114 and/or service end point 116 are limited in the types of data that they can store or the types of commands or data that they can transmit to the communication module 108. In this situation, the service end point 116 cannot transmit, or the communication module 108 cannot respond to, certain IoT device commands, e.g., for a dishwasher to start pumping water, a fan to start blowing air, a light to turn on, etc. When the user performs the device registration process for the communication module 108 (or the IoT device 102), and the IoT platform 104 (e.g., the device manager 114 or the service end point 116) receives the information identifying the communication module 108 (or the IoT device 102) from one of the user devices 112, then the IoT platform 104 (e.g., the device manager 114 or the service end point 116) removes from the unclaimed device list (or delists as an unclaimed device) the communication module 108 (or the IoT device 102) and transmits the full appliance-specific data to the communication module 108 as described above (e.g., at 224-228).

Figure 3:
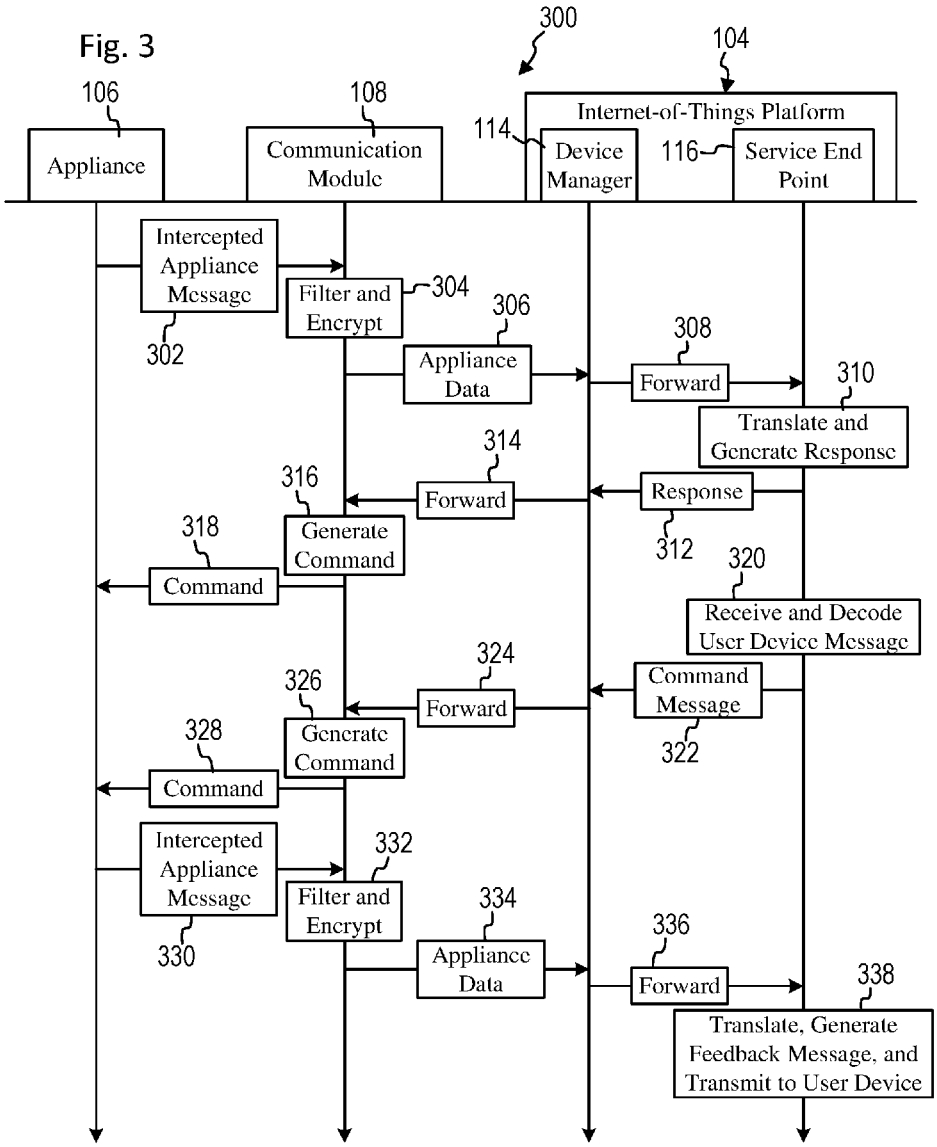
FIG. 3 illustrates a simplified workflow diagram for additional example functions of various components of the IoT system shown in FIG. 1, in accordance with some embodiments.

FIG. 3 shows a simplified workflow diagram 300 for example functions of the appliance 106, the communication module 108, and the IoT platform 104 (i.e., the device manager 114 and at least one of the service end points 116) to control the appliance 106 during regular IoT device operations, i.e., after the identification process identifies the type of the appliance 106 and establishes the capability of the communication module 108 to control the appliance 106 as an IoT device, in accordance with some embodiments. For ease of illustration and description, the illustrated embodiment is provided as just one example for the workflow functions, and some functions are either not shown or are combined with other functions. Some alternative embodiments with other example workflow functions will also be described, and still other embodiments will become apparent from a full understanding of the disclosure herein. The exact combination and order of functions in the workflow diagram 300 are, thus, provided for explanatory purposes only. Other embodiments will have other functions or combinations of functions.

In an example situation, the communication module 108 continues to intercept subsequent appliance messages (at 302) transmitted by the microcontroller and/or other components of the appliance 106. The communication module 108 filters (at 304) the subsequent appliance messages (e.g., by applying the filtering instructions or data to the subsequent appliance messages) to select a subset of the subsequent appliance messages (e.g., those containing frames, commands or data that are relevant to the operation of the particular type of the appliance 106 as an IoT device, such as command or configuration/setting data for turning on/off various components, status data to be transmitted back to the service end point 116, etc.). The filtering instructions or data, in effect, tell the communication module 108 which types of frames, commands or data to look for in the appliance messages. Thus, the communication module 108 generates only appliance data that is based on the filtered subset of the subsequent appliance messages. For this example, the intercepted appliance message that is filtered (at 304) contains a command or data directed from the microcontroller of the appliance 106 to one of the other components. In some embodiments, e.g., in some thick-client embodiments, the filtering instructions or data enable the communication module 108 to determine whether and/or how to respond to some of the subsequent appliance messages without having to involve the IoT platform 104 (e.g., the device manager 114 or the service end point 116). In some embodiments, e.g., in thin-client embodiments and some thick-client embodiments, the communication module 108 has to involve the IoT platform 104 in determining whether and/or how to respond to some of the subsequent appliance messages. In these cases, the communication module 108 encrypts (at 304) data from the intercepted and filtered appliance message to generate the appliance data and transmits (at 306) the appliance data in a network communication packet through the network 110 to the IoT platform 104, i.e., either the device manager 114 or the service end point 116.

In some embodiments, the appliance-specific data previously received and stored by the communication module 108 includes an address (e.g., IP address, DNS address, etc.) for the service end point 116, and the communication module 108 forms the network communication packet with this address in a header, so that the network communication packet can be forwarded through the network 110 directly to the service end point 116, thereby bypassing the device manager 114. In other embodiments, the communication module 108 transmits the network communication packet to the device manager 114, which receives and forwards (at 308) the appliance data to the correct service end point 116. In this case, since the identification process was previously performed, the communication module 108 includes some type of identification data in the appliance data, with which the device manager 114 can quickly determine (with reduced latency) which service end point 116 is supposed to receive the appliance data. In some embodiments, the identification data in the appliance data is the device type identifier (mentioned above), with which the device manager 114 can quickly look up the service end point 116. In some embodiments, the identification data in the appliance data is a direct unique identifier or address (e.g., IP address, DNS address, etc.) of the correct service end point 116, with which the device manager 114 can immediately forward the appliance data. In some embodiments, if the device manager 114 maintains a data store of each authorized communication module 108 with its corresponding service end point 116, then the identification data can simply be a unique identifier of the communication module 108 with which it is programmed or configured upon manufacturing, since the device manager 114 can quickly perform a data store lookup using the unique identifier to determine the service end point 116.

When the service end point 116 receives the appliance data, the parser (customized for the particular type of the appliance 106) parses the appliance data and runs a translation script (at 310) on the data using a rules engine with a schema stored in a separate data store to produce a translated version of the appliance data (or of the original appliance message). In some embodiments, the translated version is in a proprietary language used by the IoT platform 104. In some embodiments, the schema stored in the data store can be updated while the parser is running, so as not to interrupt the servicing of the IoT devices 102 or having to recompile code for the parser. Additionally, the use of the proprietary language enables additional services within the IoT platform 104 that can be built on top of the basic IoT services.

After the service end point 116 translates or decodes the appliance data, it generates a response message and transmits (at 312) the response message (e.g., as a type of appliance-specific data) back to the communication module 108, either directly to the communication module 108 (bypassing the device manager 114) or through the device manager 114, which forwards (at 314) the response message to the communication module 108. The response message generally includes a command or data with which the communication module 108 can generate a new command or data (at 316) that is transmitted (at 318) through the data communication subsystem of the appliance 106 either to the recipient component of the original command or data in the intercepted appliance message or to a different component, depending on requirements set in the service end point 116. The new command or data is generated using the appliance-specific data previously received during the identification process and is in accordance with settings, parameters or requirements for the IoT device 102, rather than for the legacy non-IoT device.

In another example situation, the service end point 116 receives (at 320) a message from the user device 112 of the user, owner or operator of the IoT device 102. Such user device messages are typically for remote operation, setting of parameters, and/or checking on a status of the IoT device 102 by the user. The service end point 116, thus, decodes the user device message to determine what type of request is being made by the user, e.g., to set a control parameter in the IoT device 102 or check on a current status thereof. Having previously identified the type of the appliance 106, the service end point 116 uses the device type identifier to generate a command message that satisfies the decoded request and transmits (at 322) the command message (e.g., as a type of appliance-specific data) to the communication module 108. The service end point 116 transmits (at 322) the command message either directly to the communication module 108 (bypassing the device manager 114) or through the device manager 114, which forwards (at 324) the command message to the communication module 108.

Similar to 316 and 318 above, the command message is decoded by the communication module 108 to generate a new command or data (at 326) that is transmitted (at 328) through the data communication subsystem of the appliance 106 to the appropriate recipient component of the appliance 106 for the request made by the user. The new command or data is generated using the appliance-specific data previously received during the identification process and is in accordance with settings, parameters or requirements for the IoT device 102, rather than for the legacy non-IoT device. In some embodiments, e.g., in some thick-client embodiments, the appliance-specific data includes instructions and/or data for the communication module 108 to receive some or all of the messages from the user device 112 of the user without having to pass the message through the service end point 116 and/or the device manager 114. In this case, the service end point 116 or the device manager 114 transmits to the user device 112 an address (e.g., IP address, DNS address, etc.) for the communication module 108, so the user device 112 can transmit network communication packets (containing the user device message) through the network 110 directly to the communication module 108. The communication module 108 then decodes the user device message to determine what type of request is being made by the user and to generate the command or data (at 326) that is transmitted (at 328) through the data communication subsystem of the appliance 106 to the appropriate recipient component of the appliance 106. to control the appliance 106 according to the request made by the user.

As at 302, the communication module 108 continues to intercept subsequent appliance messages (at 330) transmitted by the microcontroller and/or other components of the appliance 106. Therefore, if the request by the user involves a response from the IoT device 102, then filtering (at 332, as at 304) of the intercepted appliance messages will detect the response. For example, if the user is checking on the temperature indicated by a home thermostat, then the command transmitted (at 328) to the relevant component will cause that component to generate a new appliance message with the temperature status data. The intercepting and filtering (at 330 and 332, as described above for 302 and 304) will detect this appliance message. In some embodiments, e.g., in some thick-client embodiments, the appliance-specific data includes instructions and/or data for the communication module 108 to transmit some types of (or all) messages to the user device 112 of the user without having to pass the message through the service end point 116 and/or the device manager 114. In this case, the service end point 116 or the device manager 114 transmits to the communication module 108 an address (e.g., IP address, DNS address, etc.) for the user device 112, so the communication module 108 can transmit network communication packets (containing the message) through the network 110 directly to the user device 112. The communication module 108 then generates a feedback message containing the response data (e.g., the temperature status data) and transmits it to the user device 112. In some embodiments, e.g., in thin-client embodiments and some thick-client embodiments, the communication module 108 has to involve the IoT platform 104 (e.g., the device manager 114 or the service end point 116) to transmit some types of (or all) messages to the user device 112. In this case, the workflow then proceeds at 334 and 336 as described above for 306 and 308 to generate the appliance data containing data for the response and transmit it to the service end point 116.

When the service end point 116 receives (at 338) the appliance data, it proceeds as described above for 310 to parse and translate the appliance data to decode the response data. The service end point 116 generates a feedback message containing the response data and transmits it back to the user device 112.

In some embodiments, the IoT system 100 includes interlock safety programs and/or data that prevent unauthorized, inappropriate or potentially harmful commands (e.g., for an elicit or potentially harmful operation of the appliance 106) from being transmitted to, received by, and/or executed by the communication module 108. For example, the interlock safety programs/data detect an attempt by one of the user devices 112 (e.g., an unauthorized or elicit user device) to send a command to an air or water heater appliance that would set a heating element to a too high temperature level that might damage the appliance or even possibly start a fire. Other examples will be readily apparent, depending on the type and function of the various appliances 106.

In some embodiments, the interlock safety programs/data are included in the firmware of the communication module 108, so that the communication module 108 includes the interlock safety capability even before performing the authorization and/or identification process, and potential unauthorized commands are detected and deleted by the communication module 108. In some embodiments, the interlock safety programs/data are included in the appliance-specific data received by the communication module 108, so that the communication module 108 includes the interlock safety capability after performing the authorization and/or identification process, and the interlock safety programs/data can be specifically tailored to the type of the appliance 106. In some embodiments, the interlock safety programs/data are included in the IoT platform 104 (e.g., in the service end point 116), so that the service end point 116 includes the interlock safety capability, and potential unauthorized commands are detected and deleted by the service end point 116 before they are transmitted to the communication module 108. In some embodiments, the interlock safety programs/data are included in the microcontroller and/or electronic memory of the appliance 106, which is less vulnerable to being tampered with than are the firmware and programs/data of the communication module 108 or the IoT platform 104.

As is apparent from the above description, the communication module 108, the device manager 114, the service end points 116, the identification process, and the subsequent functions for controlling the appliance 106 enable advantages over conventional IoT device development techniques and IoT systems. In particular, since it is the identification process that establishes the capability of the communication module 108 to control the appliance 106 as an IoT device, a single version of the communication module 108 can be inserted into a variety of legacy non-IoT devices, thereby leveraging an economy of scale for production of the communication module 108 or standardizing much of the design process, which results in a faster design process and shorter time-to-market than for conventional IoT device development. Additionally, since the communication module 108, the identification process, and the subsequent functions for controlling the appliance 106 are able to work with the legacy internal appliance messaging of the appliance 106, the communication module 108 can be inserted into the legacy non-IoT device architecture with a minimal redesign thereof, thereby reducing the chance for problems occurring during the design process or afterwards during use of the IoT devices 102 in the IoT system. In some situations, for example, the redesign simply involves the addition of an integrated circuit (IC) chip (for the communication module 108) onto an existing printed circuit board of the legacy non-IoT device, which is virtually unheard of in conventional IoT device development. The present invention, therefore, represents improvements in IoT device development technologies and in IoT system operation technologies.

Figure 4:
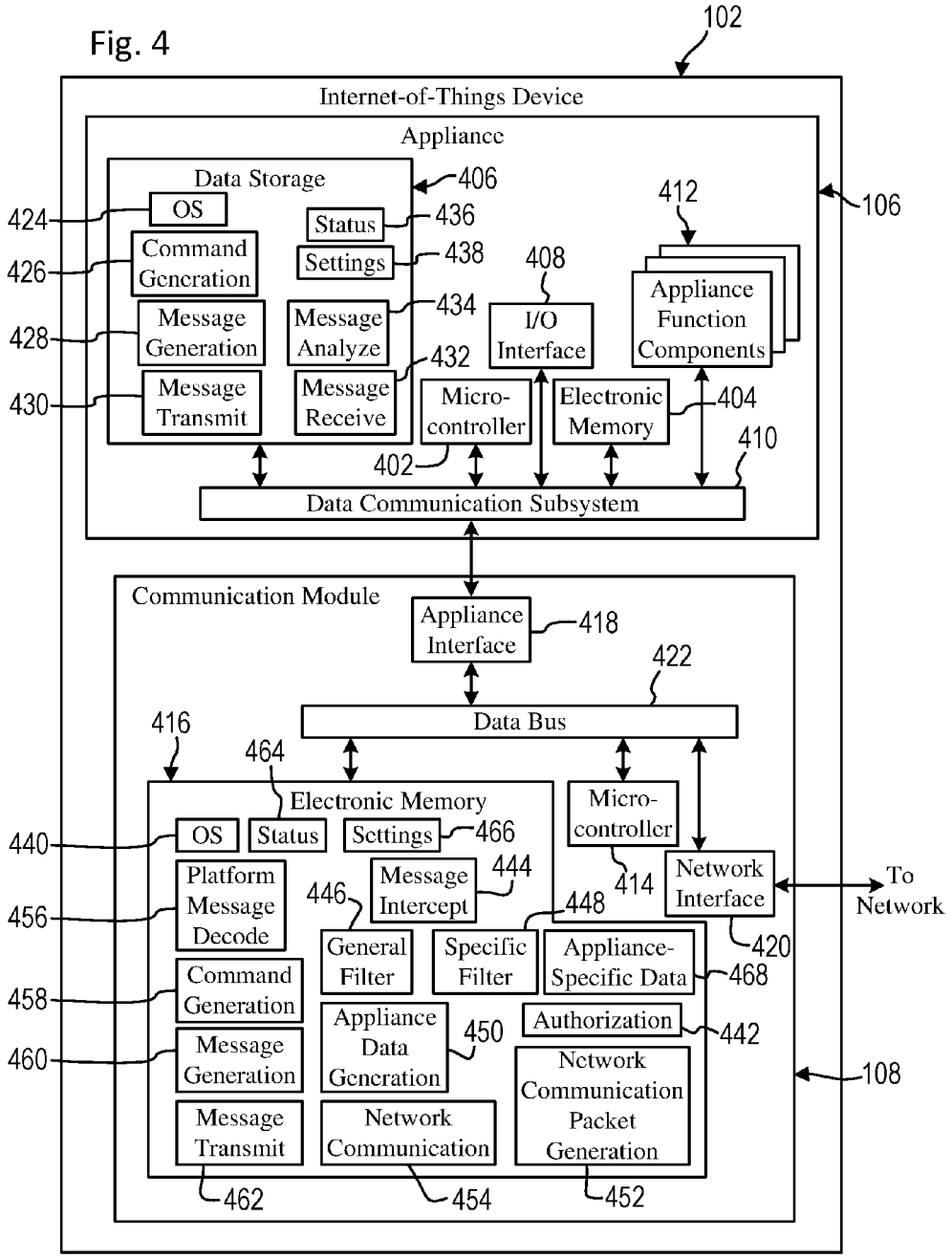
FIG. 4 illustrates a simplified schematic diagram of an example IoT device for use in the IoT system shown in FIG. 1, in accordance with some embodiments.

FIG. 4 shows a simplified schematic diagram of an example design for the IoT device 102, including the appliance 106 and the communication module 108, in accordance with some embodiments. In the example design, the appliance 106 generally includes a microcontroller 402, an electronic memory 404, a data storage 406, a user I/O interface 408, a data communication subsystem 410, and various appliance function components 412, among other possible components not shown for simplicity of illustration and description. Additionally, the communication module 108 generally includes a microcontroller 414, an electronic memory 416, an appliance interface 418, a network interface 420, and a data bus 422, among other possible components not shown for simplicity of illustration and description. The illustrated components, component names, and component descriptions are provided for illustrative and explanatory purposes for some embodiments. Other embodiments may use different specific components or combinations of components with different names and descriptions. Additionally, other embodiments may combine some or all of the functions of one component into another component or divide the functions of one component into multiple individual components.

The appliance function components 412 generally represent various components for performing the appliance-specific functions of the IoT device 102, e.g., a pump for pumping water in a dishwasher, a heat exchanger for heating or cooling air in an air conditioner, a heating element for heating water in a water heater, a temperature sensor in a thermostat, water level sensor in a humidifier, etc. Some of these types of components have electrical control inputs by which they receive commands or signals that control the component's operation, e.g., on/off signals, parameter settings, etc. Additionally, some of these types of components produce output data or signals indicative of operational status, such as a temperature of an element, whether water is flowing, whether an air passage is blocked. The various commands, data, signals, etc. that are provided to or received from the appliance function components 412 are the subject of some of the appliance messages described above. For example, in an embodiment in which the appliance 106 is a thermostat, one of the appliance function components 412 could be a burner switch, and one of the appliance messages could be a "heat-on" message transmitted by the microcontroller 402 to close the burner switch, thereby turning on a heating element of an air heating or air conditioning system.

The components 402-410 of the appliance 106 generally represent various electronic devices typically on one or more printed circuit board (PCB). For example, the microcontroller 402 generally represents any appropriate one or more central processing unit, microcontrol unit, microprocessor unit, or embedded microprocessor. The electronic memory 404 and the data storage 406 generally represent any appropriate combination of non-transitory computer readable media, such as one or more RAM modules, ROM modules, fast access random access electronic memory, persistent mass storage devices, hard drives, optical drives, network-attached storage devices, flash drives, or other volatile or non-volatile memory components. The user I/O interface 408 generally represents one or more appropriate user interface devices, such as keypads, keyboards, touch pads, pointing devices, display screens, indicator lights, etc. The data communication subsystem 410 generally represents any appropriate communication hardware, such as one or more parallel or serial data buses and/or signal wires (e.g., $I^2C$, TTL serial, RS485, RS232, Controller Area Network (CAN bus or CANbus), Open Automated Demand Response (OpenADR), Common Industrial Protocol (CIP), Modbus, various manufacturer-specific bus systems, industry standard computer data buses, etc.), for communicatively connecting the other components 402-408 and 412 either in a single unit or in a distributed manner on one or more PCB.

The components 414-422 of the communication module 108 generally represent various electronic devices typically on one or more PCB, which can be the same one or more PCB for the components of the appliance 106. For example, the microcontroller 414 generally represents any appropriate one or more central processing unit, microcontrol unit, microprocessor unit, or embedded microprocessor. The electronic memory 416 generally represents any appropriate combination of non-transitory computer readable media, such as one or more RAM modules, ROM modules, fast access random access electronic memory, persistent mass storage devices, hard drives, optical drives, network-attached storage devices, flash drives, or other volatile or non-volatile memory components. The appliance interface 418 generally represents any appropriate data interface component, such as a bus interface, bridge device, etc., that is adapted to copy all data traffic occurring on the data communication subsystem 410 and forward it to the data bus 422. The network interface 420 generally represents any appropriate networking device, such as a network adapter, wired/wireless adapter, etc. for communicating through the Internet or with other WAN or LAN devices or computing devices. The data bus 422 generally represents any appropriate communication hardware, such as one or more parallel or serial data buses and/or signal wires (e.g., such as those described above for the data communication subsystem 410), for communicatively connecting the other components 414-420 either in a single unit or in a distributed manner on one or more PCB.

The illustrated design for the communication module 108 is an example for some embodiments in which the communication module 108 represents a single IC chip inserted into the PCB or circuitry for the appliance 106 with a single interface (the appliance interface 418) communicatively coupled to the data communication subsystem 410. On the other hand, the additional data bus 422 and the appliance interface 418 are not needed in some embodiments in which the communication module 108 represents separate IC chips for the microcontroller 414, the electronic memory 416, and the network interface 420, since the individual IC chips for these components 414, 416 and 420 can be inserted into the PCB or circuitry for the appliance 106, so that each is communicatively coupled to the data communication subsystem 410. Furthermore, the microcontroller 414 is not needed in some embodiments in which the communication module 108 includes firmware executed by the microcontroller 402 of the appliance 106, and the electronic memory 416 is also not needed if that firmware is loaded into the electronic memory 404 (or the data storage 406) of the appliance 106.

The data storage 406 of the appliance 106 is shown storing the various firmware (programs and data) used by the microcontroller 402 and the electronic memory 404 to control the functions of the appliance 106, e.g., as described above. For example, the programs and data generally include an operating system (OS) 424, a command generation routine 426, a message generation routine 428, a message transmit routine 430, a message receive routine 432, a message analyze routine 434, status data 436, and settings data 438, among other possible programs and data (and programs combined with data) not shown for simplicity of illustration and description. The illustrated programs/data, programs/data names, and programs/data descriptions are provided for illustrative and explanatory purposes for some embodiments. Other embodiments may use different specific programs and/or data or combinations thereof with different names and descriptions. Additionally, other embodiments may combine some or all of the functions or purpose of one program and/or data into another program and/or data or divide the functions of one program and/or data into multiple individual programs and/or data. The programs and data 424-438 are loaded into the electronic memory 404 and executed, processed or generated by the microcontroller 402.

The operating system 424 generally represents any appropriate embedded OS or real-time OS for handling the low-level functions that support the other programs and data 426-438, e.g., for reading or writing data from or to the electronic memory 404 or the data storage 406. The command generation routine 426 generally generates the command code (along with any status or settings data) to be included in the outgoing appliance messages (based on data in the status or settings or previously received appliance messages) to control any of the other components 404-408 or 412. The message generation routine 428 generally generates the outgoing appliance messages using the generated command code. The message transmit routine 430 (which may be part of the OS 424) generally handles communications with the data communication subsystem 410 to transmit the generated appliance messages that originate from the microcontroller 402 and are directed to the other components 404-408 or 412. (The communication module 108 intercepts these messages and filters them for further actions, as described above.) The message receive routine 432 (which may be part of the OS 424) generally handles communications with the data communication subsystem 410 to receive appliance messages that originate from the other components 404-408 or 412 or from the communication module 108 and are directed to the microcontroller 402. The message analyze routine 434 generally extracts the contents of the received appliance messages to determine the appropriate response, such as reading or writing values to the status data 436 or the settings data 438 or initiating a new command generation. (The contents of the appliance messages received from the communication module 108, for example, cause the microcontroller 402 to perform legacy functions of the appliance 106, but in the context of an IoT device.) The status data 436 generally represent any appropriate values related to status parameters, e.g., as reported by the appliance function components 412 to indicate their status or functionality. The settings data 438 generally represent any appropriate values used to set operating parameters, e.g., as provided to the appliance function components 412 to control their operation.

The electronic memory 416 of the communication module 108 is shown storing the various firmware (programs and data) used by the microcontroller 414 to control the functions of the communication module 108, e.g., as described above. For example, the programs and data generally include an operating system 440, an authorization routine 442, a message intercept routine 444, a general filter routine and data 446, a specific filter routine and data 448, an appliance data generation routine 450, a network communication packet generation routine 452, a network communication routine 454, a platform message decode routine 456, a command generation routine 458, a message generation routine 460, a message transmit routine 462, status data 464, settings data 466, appliance-specific data 468, among other possible programs and data (and programs combined with data) not shown for simplicity of illustration and description. The illustrated programs/data, programs/data names, and programs/data descriptions are provided for illustrative and explanatory purposes for some embodiments. Other embodiments may use different specific programs and/or data or combinations thereof with different names and descriptions. Additionally, other embodiments may combine some or all of the functions or purpose of one program and/or data into another program and/or data or divide the functions of one program and/or data into multiple individual programs and/or data. The programs and data 440-468 are executed, processed or generated by the microcontroller 414 and/or received by the communication module 108 from the IoT platform 104.

In some embodiments in which the communication module 108 does not maintain a persistent state from a previous power-on period, as mentioned above, the programs and/or data that are specific to the particular type of the appliance 106 are maintained only in a volatile memory component of the electronic memory 416 that is used in cooperation with the microcontroller 414. Other programs and data, e.g., those needed to perform the authorization and identification processes described above, are maintained in a non-volatile memory component of the electronic memory 416, and may be loaded into a volatile memory component that is used in cooperation with the microcontroller 414 during operation. On the other hand, in some embodiments in which the communication module 108 does maintain a persistent state from a previous power-on period, as mentioned above, the programs and/or data that are specific to the particular type of the appliance 106 are maintained in a non-volatile memory component of the electronic memory 416, and may be loaded into a volatile memory component that is used in cooperation with the microcontroller 414 during operation.

The operating system 440 generally represents any appropriate embedded OS or real-time OS for handling the low-level functions that support the other programs and data 442-468. The authorization routine 442 generally performs the authorization process described above. The message intercept routine 444 generally receives (i.e., intercepts) all of the appliance messages that are transmitted across the data communication subsystem 410, either through the appliance interface 418 and the data bus 422, or directly from the data communication subsystem 410. During the identification process, the general filter routine and data 446 generally filters the intercepted appliance messages to find specific message types, as described above. On the other hand, in some embodiments in which the communication module 108 uses every appliance message that it intercepts during the identification process, as described above, the general filter routine and data 446 is not needed. During regular IoT device operations, the specific filter routine and data 448 generally filters the intercepted appliance messages according to the filtering or polling instructions or data received in the appliance-specific data at the end of the identification process, as described above. The appliance data generation routine 450 generally generates the appliance data based on the filtered appliance messages (or all intercepted appliance messages) during either the identification process or the regular IoT device operations. The network communication packet generation routine 452 generally generates the network communication packets containing the appliance data to be transmitted to the IoT platform 104. The network communication routine 454 (which may be part of the OS 440) generally handles communications with the network interface 420 to transmit and receive the outgoing and incoming network communication packets to and from the IoT platform 104 through the network 110. During the identification process, the platform message decode routine 456 generally decodes the appliance-specific data received in the incoming network communication packets from the IoT platform 104 in order to store the device type identifier, filtering or polling instructions or data, executable program instructions, and/or other types of data or instructions (for the specific type of appliance that the appliance 106 has been determined to be) that are used by the communication module 108 to control the appliance 106 (i.e., its components) as a fully functional IoT device. During regular IoT device operations, the platform message decode routine 456 generally decodes the appliance-specific data received in the incoming network communication packets in order to identify, or determine how to handle, the commands or responses received from the service end point 116, as described above. The command generation routine 458 generally generates the appropriate command code (along with any appropriate data) that control the appliance 106 (or its various components) in accordance with command or response received from the service end point 116 during regular IoT device operations. The message generation routine 460 generally generates an appliance message containing the command code in accordance with protocols used by the appliance 106. The message transmit routine 462 (which may be part of the OS 440) generally handles communications through the data bus 422 and the appliance interface 418 to data communication subsystem 410, or directly to the data communication subsystem 410, to transmit the generated appliance message to the microcontroller 402 or the other components 404-408 or 412 of the appliance 106 to control the functions thereof as an IoT device. The status data 464 generally represent any appropriate values related to status parameters, e.g., as reported from the appliance 106 or by any components of the communication module 108 to indicate their status or functionality. The settings data 466 generally represent any appropriate values used to set operating parameters of the communication module 108, e.g., as provided from the service end point 116 to control the operation of the communication module 108 and/or the appliance 106. The appliance-specific data 468 generally represents part or all of the previously described application-specific data received by the communication module 108 from the IoT platform 104; although some of the other programs and data 442-466 are part of or are updated by the previously described application-specific data.

In some embodiments in which the communication module 108 includes firmware executed by the microcontroller 402 of the appliance 106, particularly if that firmware is loaded into the electronic memory 404 (or the data storage 406) of the appliance 106, some of the programs or data shown stored in the electronic memory 416 may not be necessary or may be combined with some of the programs or data shown stored in the electronic memory 406. For example, in this situation, the operating system 424 can be used in place of the operating system 440. Additionally, the command generation routine 426, message generation routine 428, and message transmit routine 430 of the appliance 106 can be leveraged to provide some or all of the functions of the command generation routine 458, message generation routine 460, and message transmit routine 462, respectively, of the communication module 108.

With the appliance interface 418 and the message intercept routine 444, among other components, the communication module 108 for each IoT device 102 is adapted to: be communicatively coupled to the appliance 106 (e.g., through a data bus, i.e., the data communication subsystem 410), receive the appliance messages therefrom (e.g., by intercepting the appliance messages from the data bus), generate the appliance commands based on the appliance-specific data, and control the function of the appliance 106 (e.g., by transmitting the appliance commands through the data communication subsystem 410 to the components 402-408 and/or 412 of the appliance 106). With the network interface 420 and the network communication routine 454, among other components, the communication module 108 is adapted to: be communicatively coupled to the network 110, transmit the appliance data based on the appliance messages through the network 110, and receive the appliance-specific data that depends on the identity of the appliance 106 through the network 110. Additionally, in some embodiments, with these components 418, 420, 444 and 454, among other components, the communication module 108 is further adapted to: receive the appliance messages, transmit the appliance data, and perform the identification process every time the communication module 108 is powered on. Furthermore, in some embodiments in which the communication module 108 does not maintain a persistent state from a previous power-on period, every time the communication module 108 is powered on, the communication module 108 is not adapted to control the function of the appliance 106 until after performing the identification process and receiving the appliance-specific data. Additionally, in some embodiments, with these components 418, 420, 444 and 454, among other components, the communication module 108 is further adapted to receive the appliance message and transmit the appliance data without having any instructions or data that are specific to the identity of the appliance 106 during the identification process. Also, in some embodiments, with the components 418, 420, 444, 446 and 454, among other components, the communication module 108 is further adapted to form the filtered version of the appliance message by filtering the appliance messages for a predetermined message type. Additionally, with the components 416, 420, 440 and 454-462, among other components, the communication module 108 is further adapted to: store instructions and data (e.g., filtering instructions and data received in the appliance-specific data) in the non-transitory memory 416, generate the appliance commands by processing the instructions and data (e.g., filtering subsequent appliance messages by applying the filtering data to the subsequent appliance messages to select a subset of the subsequent appliance messages), and transmit through the network 110 to the IoT platform 104 only the appliance data that is based on the subset of the subsequent appliance messages. Additionally, with the components 420 and 454-458, among other components, the communication module 108 is further adapted to generate the appliance commands based on a response received from the service end point 116 of the IoT platform 104.

Figure 5:
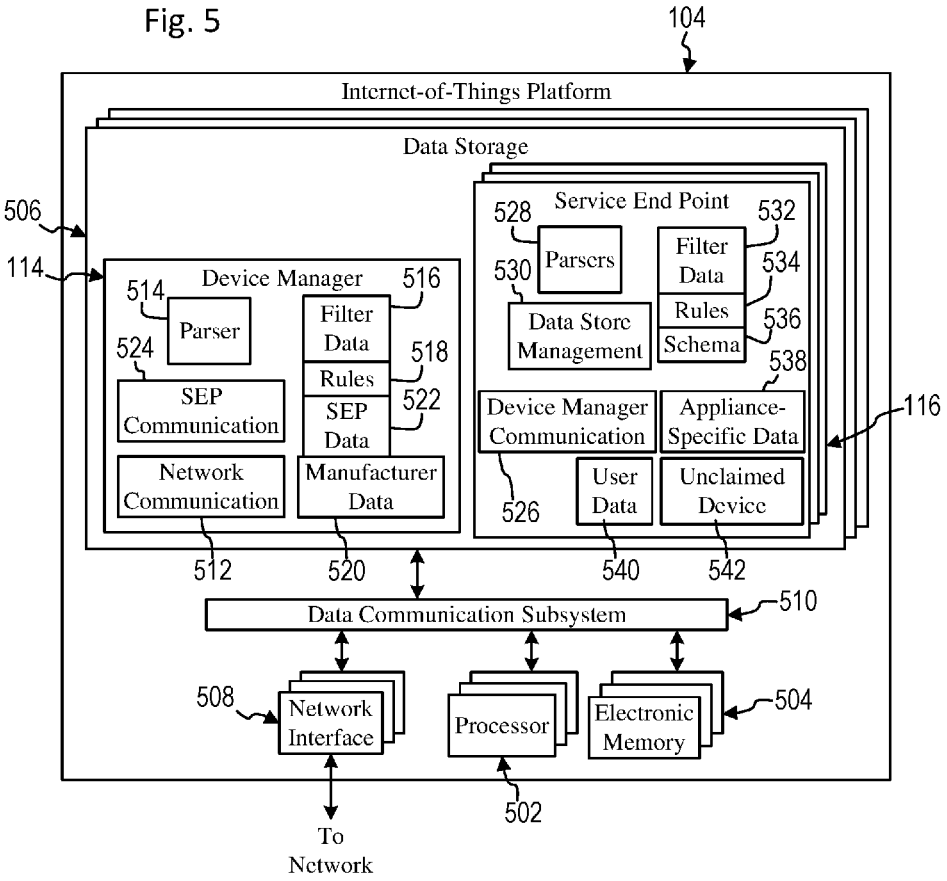
FIG. 5 illustrates a simplified schematic diagram of an example IoT platform for use in the IoT system shown in FIG. 1, in accordance with some embodiments.

FIG. 5 shows a simplified schematic diagram of an example design for the IoT platform 104, including the device manager 114 and the service end points 116 instantiated in a cloud-based computing system, in accordance with some embodiments. In the example design, the IoT platform 104 generally includes multiple processors 502, multiple electronic memory devices 504, multiple data storage devices 506, multiple network interfaces 508, and a data communication subsystem 510, among other possible components not shown for simplicity of illustration and description. The illustrated components, component names, and component descriptions are provided for illustrative and explanatory purposes for some embodiments. Other embodiments may use different specific components or combinations of components with different names and descriptions. Additionally, other embodiments may combine some or all of the functions of one component into another component or divide the functions of one component into multiple individual components.

In the example design, the components 502-510 of the IoT platform 104 generally represent various electronic devices that form a distributed cloud-based computing system. Thus, the processors 502 generally represent any appropriate number of central processing units, e.g., in one or more rack-mounted computing systems in one or more server farms. Similarly, the electronic memory devices 504 generally represent any appropriate combination of non-transitory computer readable media, such as various RAM modules typically associated with such processors 502. The data storage devices 506 generally represent any appropriate combination of non-transitory computer readable media, such as persistent mass storage devices, hard drives, optical drives, network-attached storage devices, flash drives, etc. The network interfaces 508 generally represent any number of networking devices, such as network adapters, routers, switches, hubs, etc., needed to connect all of the various processors 502 to the network 110. The data communication subsystem 510 generally represents any appropriate communication hardware, such as wired or wireless LANs, WANs, internal and external parallel/serial data buses and/or signal wires, etc., for communicatively connecting the other components 502-508 throughout the distributed cloud-based computing system.

The data storage devices 506 are shown storing the various programs and data that instantiate the device manager 114 and the service end points 116 to perform the functions described above. For example, the programs and data for the device manager 114 generally include network communication programs 512, a parser 514, various types of data (e.g., filter data 516, rules 518, manufacturer data 520, and service end point data 522), and service end point communication programs 524, among other possible programs and data (and programs combined with data) not shown for simplicity of illustration and description. The programs and data for the service end points 116 generally include device manager communication programs 526, parsers 528, data store management programs 530, various types of parser data (e.g., filter data 532, rules 534, and schema 536), appliance-specific data 538, user data 540, and unclaimed device data 542, among other possible programs and data (and programs combined with data) not shown for simplicity of illustration and description. The illustrated programs/data, programs/data names, and programs/data descriptions are provided for illustrative and explanatory purposes for some embodiments. Other embodiments may use different specific programs and/or data or combinations thereof with different names and descriptions. Additionally, other embodiments may combine some or all of the functions or purpose of one program and/or data into another program and/or data or divide the functions of one program and/or data into multiple individual programs and/or data. The programs and data 512-524 are loaded into some of the various electronic memory devices 504, and executed, processed or generated by some of the processors 502, used to handle the functions of the device manager 114. Similarly, the programs and data 526-542 are loaded into some of the various electronic memory devices 504, and executed, processed or generated by some of the processors 502, used to handle the functions of the service end points 116.

The network communication programs 512 generally handle communications with the network interfaces 508 to generate/decode and transmit/receive the outgoing and incoming network communication packets to and from the IoT devices 102 through the network 110. The parser 514 generally handles the initial parsing of the appliance data received in the network communication packets to determine the corresponding service end point 116 that is adapted to respond to the appliance data received from the communication modules 108 of each type of appliance for the IoT devices 102. The filter data 516, rules 518, manufacturer data 520, and service end point data 522 are maintained in a data store (e.g., one or more databases, flat file systems, configuration files, key-value stores/databases, cloud-based data service, etc.) and are generally used by the parser 514 to analyze the appliance data during the identification process, determine the manufacturer of the IoT device 102 for which the communication module 108 sent the appliance data, and determine the corresponding service end point 116. The service end point communication programs 524 generally handle communications with the service end points 116, such as forwarding of the appliance data to the correct service end point 116 after it has been determined, receiving the responses back from the service end points 116, and forwarding them through the network communication programs 512, the network interfaces 508, and the network 110 to the correct communication modules 108. When appliance data is received from a communication module 108 for which the corresponding service end point 116 has already been determined, the parser 514 transfers the appliance data to the service end point communication programs 524 to forward the appliance data.

The device manager communication programs 526 for each service end point 116 generally handle communications with the device manager 114, such as receiving the appliance data that was sent from corresponding communication modules 108, and transmitting back the appropriate responses and appliance-specific data. The parsers 528 translate the received appliance data to determine the device type identifier and the correct appliance-specific data for the communication module 108 that sent the appliance data during the identification process, and generate the commands or other responses to be transmitted back during regular IoT device operations for the communication modules 108. The data store management programs 530 generally handle the data store lookups or traversals for parsing the appliance data. The filter data 532, rules 534, schema 536 are maintained in a data store (e.g., one or more databases, flat file systems, configuration files, key-value stores/databases, cloud-based data service, etc.) managed by the data store management programs 530 and are generally used by the parsers 528 to parse and analyze the appliance data during the identification process and during regular IoT device operations. The appliance-specific data 538 (e.g., also maintained in a data store) contains the correct appliance-specific data (e.g., including the device type identifiers, the filtering or polling instructions or data, the command codes/data, the executable program instructions, and/or other types of data or instructions that are used by the communication modules 108 to control the appliances 106 as fully functional IoT devices) that is to be transmitted back to the communication module 108. The user data 540 (e.g., also maintained in a data store) contains the information obtained from the user or user device 112, e.g., data entered during the device registration process described above, as well as configuration information entered by the user for generally managing the IoT device 102 and/or the manner in which the service end point 116 controls or communicates with the communication module 108, among other user-related information. The unclaimed device data 542 (e.g., also maintained in a data store) contains the data that lists or maintains the unclaimed, unregistered, or inactivated communication modules 108 (or IoT devices 102), the limited set of instructions that are provided to the unclaimed devices, and/or the limited set of instructions that the service end point 116 and the device manager 114 can perform with respect to the various types of unclaimed devices, among other unclaimed-device-related programs and/or data.

With the components 508, 512-538, among other components, the IoT platform 104 (via the device manager 114 and/or the service end points 116) is adapted to: be communicatively coupled to the network 110, receive the appliance data through the network 110 from the communication modules 108, determine the identities of the appliances 106 based on the appliance data, and transmit the appliance-specific data through the network 110 to the communication modules 108. With the components 528-538, among other components, each service end point 116 is adapted to respond to the appliance data received from the communication modules 108 communicatively coupled to the appliances 106 classified in the group of related appliances that correspond to that service end point 116. With the components 512-524, among other components, the device manager 114 is adapted to: receive the appliance data, determine from the appliance data which of the plurality of groups of related appliances is the group in which the appliance 106 (for which the communication module 108 transmitted the appliance data) is classified, determine from the group in which the appliance 106 is classified which of the service end points 116 is the service end point 116 adapted to respond to the appliance data, and transmit the appliance data to that service end point 116. With the components 526-538, among other components, each service end point 116 is adapted to: determine the identity of the appliance 106 based on the appliance data received from the communication module 108 communicatively coupled to that appliance 106, and transmit the appliance-specific data through the network 110 to the communication module 108. With the components 528-538, among other components, the IoT platform 104 (via the service end points 116) is adapted to select filtering instructions and/or data (e.g., included in the appliance-specific data) based on the identity of the appliance. With the components 508, 512, 524-538, among other components, the IoT platform 104 (the device manager 114 and/or via the service end points 116) is adapted to receive the appliance data (that is based on a filtered subset of subsequent appliance messages), generate a response to this appliance data, and transmit the response through the network 110 to the communication module 108 that transmitted this appliance data.

While the specification has been described in detail with respect to specific embodiments of the invention, it will be appreciated that those skilled in the art, upon attaining an understanding of the foregoing, may readily conceive of alterations to, variations of, and equivalents to these embodiments. The various databases and servers mentioned in the specification could be instantiated by hardware in the same datacenter or in alternative datacenters at disparate locations. In situations where the servers host incompatible platforms the servers would likely be in separate datacenters but may not be as different companies may utilize the same datacenter by leasing the services of a third company. Any of the method steps discussed above can be conducted by a processor operating with a computer-readable non-transitory medium storing instructions for those method steps. The computer-readable medium may be memory within an electronic device itself or a network accessible memory. These and other modifications and variations to the present invention may be practiced by those skilled in the art, without departing from the scope of the present invention, which is more particularly set forth in the appended claims.

What is claimed is:

1. A method comprising:

receiving, by a communication module from a data communication subsystem of an appliance, an appliance message that was transmitted from a component of the appliance through the data communication subsystem;

receiving, by the communication module, a plurality of appliance messages transmitted through the data communication subsystem, the appliance message being one of the plurality of appliance messages;

filtering, by the communication module, the plurality of appliance messages for a predetermined message type to obtain the appliance message;

generating, by the communication module, appliance data based on the appliance message;

deleting other received appliance messages of the plurality of appliance messages;

transmitting, by the communication module to an Internet-of-Things (IoT) platform adapted to determine an identity of the appliance, the appliance data; and receiving, by the communication module from the IoT platform, appliance-specific data based on the identity of the appliance;

wherein the communication module is capable of controlling the appliance as an IoT device only after, and not before, the receiving of the appliance-specific data.

2. The method of claim 1, wherein:

the component of the appliance that transmitted the appliance message is a controller of the appliance; and the appliance message was transmitted from the controller of the appliance to a functional component of the appliance to control a function of the appliance that does not involve the communication module.

3. The method of claim 1, further comprising:

receiving, by the IoT platform, the appliance data;

determining, by the IoT platform, the identity of the appliance based on the appliance data; and transmitting, by the IoT platform to the communication module, the appliance-specific data based on the identity of the appliance.

4. The method of claim 3, further comprising:

after the step of determining the identity of the appliance and before the step of transmitting the appliance-specific data:

listing, by the IoT platform, the communication module as an unclaimed device with restricted operation capabilities;

receiving, by the IoT platform from a user device, information identifying the communication module; and delisting, by the IoT platform, the communication module as the unclaimed device.

5. The method of claim 3, wherein the determining of the identity of the appliance further comprises:

parsing the appliance data using a rule stored in a data store to locate a desired data relative to a known location in the appliance data; and translating the desired data according to a schema specified by the rule.

6. The method of claim 3, wherein the step of determining the identity of the appliance further comprises:

determining, by a device manager of the IoT platform, a group of appliances in which the appliance is classified, the group of appliances in which the appliance is classified being one of a plurality of groups of appliances;

determining, by the device manager, a selected service end point of the IoT platform, the selected service end point being one of a plurality of service end points, each service end point of the plurality of service end points corresponding to at least one group of appliances of the plurality of groups of appliances, and the selected service end point corresponding to the group of appliances in which the appliance is classified;

transmitting, by the device manager to the selected service end point; the appliance data; and determining, by the selected service end point, the identity of the appliance based on the appliance data.

7. The method of claim 6, further comprising:

receiving, by the selected service end point from a user device, a user device message for a selected function of the appliance;

generating, by the selected service end point, a command message instructing the communication module to cause the appliance to perform the selected function;

transmitting, by the selected service end point to the communication module, the command message;

receiving, by the communication module, the command message;

generating, by the communication module, a command based on the command message and the appliance-specific data; and transmitting, by the communication module to the appliance, the command causing the appliance to perform the selected function;

wherein the communication module cannot perform the step of generating the command until after performing the steps of receiving the appliance message, transmitting the appliance data, and receiving the appliance-specific data.

8. The method of claim 1, further comprising:

generating, by the communication module, an appliance command based on the appliance-specific data, the appliance command controlling at least one function of the appliance; and transmitting, by the communication module through the data communication subsystem to the component of the appliance, the appliance command.

9. The method of claim 8, wherein:

the communication module cannot perform the steps of generating and transmitting the appliance command until after performing the steps of receiving the appliance message, transmitting the appliance data, and receiving the appliance-specific data.

10. The method of claim 8, wherein:

the communication module performs the steps of receiving the appliance message and transmitting the appliance data every time the communication module is powered on; and every time the communication module is powered on, the communication module does not perform the steps of generating and transmitting the appliance command controlling at least one function of the appliance until after the step of receiving the appliance-specific data.

11. The method of claim 1, further comprising:

receiving, by a service end point of the IoT platform from a user device, a command for a selected function of the appliance;

detecting, by at least one of: the communication module, the service end point and a microcontroller of the appliance, that the selected function is a potentially harmful operation of the appliance;

deleting, by the at least one of: the communication module, the service end point and the microcontroller, the command.

12. The method of claim 1, further comprising:

transmitting, by the communication module through the data communication subsystem, a trigger appliance message that causes the component to generate and transmit the appliance message in response to the trigger appliance message.

13. The method of claim 1, further comprising:

receiving, by the communication module from the appliance, the plurality of appliance messages that were transmitted from at least one component of the appliance through the data communication subsystem;

generating, by the communication module only once prior to the receiving of the appliance-specific data, the appliance data based on the appliance message; and transmitting, by the communication module only once prior to the receiving of the appliance-specific data, the appliance data.

14. The method of claim 1, further comprising:

receiving, by the communication module from the appliance, the plurality of appliance messages that were transmitted from at least one component of the appliance through the data communication subsystem;

generating, by the communication module prior to the receiving of the appliance-specific data, a plurality of appliance data based on the plurality of appliance messages; and transmitting, by the communication module to the IoT platform prior to the receiving of the appliance-specific data, the plurality of appliance data.

15. The method of claim 1, further comprising:

receiving, by the communication module from the appliance, the plurality of appliance messages that were transmitted from at least one component of the appliance through the data communication subsystem;

generating, repeatedly at periodic intervals by the communication module prior to the receiving of the appliance-specific data, the appliance data based on the plurality of appliance messages; and transmitting, repeatedly at the periodic intervals by the communication module to the IoT platform prior to the receiving of the appliance-specific data, the appliance data.

16. The method of claim 1, wherein:

the appliance is a thermostat;

the component of the appliance that transmitted the appliance message is a controller of the appliance;

the appliance message was transmitted from the controller to a burner switch; and the appliance message is a heat-on message that closes the burner switch to turn on a heating element.

17. A method comprising:

receiving, by a communication module from a data communication subsystem of an appliance, an appliance message that was transmitted from a component of the appliance through the data communication subsystem;

determining, by the communication module, an initial identification of the appliance based on the appliance message;

generating, by the communication module, appliance data based on the appliance message and the initial identification;

transmitting, by the communication module to an Internet-of-Things (IoT) platform adapted to determine an identity of the appliance, the appliance data;

receiving, by the IoT platform, the appliance data;

determining, by the IoT platform, the identity of the appliance based on the appliance data using the initial identification to focus the determining of the identity;

transmitting, by the IoT platform to the communication module, appliance-specific data based on the identity of the appliance; and receiving, by the communication module from the IoT platform, the appliance-specific data based on the identity of the appliance;

wherein the communication module is capable of controlling the appliance as an IoT device only after, and not before, the receiving of the appliance-specific data.

18. A system comprising:

a communication module adapted to:

be communicatively coupled to an appliance that performs a function by transmitting appliance messages through a communication subsystem between components of the appliance, be communicatively coupled to a network, receive an appliance message, the appliance message being one of the appliance messages, transmit appliance data based on the appliance message through the network, receive appliance-specific data that depends on an identity of the appliance through the network, generate appliance commands based on the appliance-specific data, and control the function of the appliance by transmitting the appliance commands through the communication subsystem to the components of the appliance; and an Internet-of-Things (IoT) platform adapted to:

be communicatively coupled to the network, receive the appliance data through the network from the communication module, determine the identity of the appliance based on the appliance data, and transmit the appliance-specific data through the network to the communication module;

wherein:

the appliance-specific data includes filtering data;

the IoT platform is further adapted to select the filtering data based on the identity of the appliance;

the communication module is further adapted to: store the filtering data in a non-transitory memory, filter subsequent appliance messages by applying the filtering data to the subsequent appliance messages to select a subset of the subsequent appliance messages, and transmit through the network to the IoT platform only second appliance data that is based on the subset of the subsequent appliance messages;

the IoT platform is further adapted to: receive the second appliance data, generate a response to the second appliance data, and transmit the response through the network to the communication module; and the communication module is further adapted to generate the appliance commands based on the response.

19. The system of claim 18, wherein:

the communication module is further adapted to receive the appliance message and transmit the appliance data every time the communication module is powered on; and every time the communication module is powered on, the communication module is not adapted to control the function of the appliance until after receiving the appliance-specific data.

20. The system of claim 18, further comprising:

a plurality of communication modules adapted to be communicatively coupled to a plurality of appliances, each of which is classified in a group that is one of a plurality of groups of related appliances, the communication module being one of the plurality of communication modules, and the appliance being one of the plurality of appliances;

a plurality of service end points within the IoT platform, each service end point corresponding to a group of related appliances in the plurality of groups of related appliances, each service end point being adapted to respond to the appliance data received from the communication modules communicatively coupled to the appliances classified in the corresponding group of related appliances; and a device manager within the IoT platform adapted to:

receive the appliance data, determine from the appliance data which of the plurality of groups of related appliances is the group in which the appliance is classified, determine from the group in which the appliance is classified which of the plurality of service end points is the service end point adapted to respond to the appliance data, and transmit the appliance data to the service end point that is adapted to respond to the appliance data;

wherein the service end point that is adapted to respond to the appliance data is further adapted to:

determine the identity of the appliance based on the appliance data, and transmit the appliance-specific data through the network to the communication module.

21. The system of claim 18, wherein:

the communication module is further adapted to receive the appliance message and transmit the appliance data without having any instructions or data that are specific to the identity of the appliance.

22. The system of claim 18, wherein:

the appliance data is an unmodified version of the appliance message.

23. The system of claim 18, wherein:

the appliance data is a filtered version of the appliance message; and the communication module is further adapted to form the filtered version of the appliance message by filtering the appliance messages for a predetermined message type.

24. The system of claim 18, wherein:

the communication subsystem of the appliance includes a data bus;

the components of the appliance include a processor;

the processor transmits the appliance messages via the data bus to other components;

the communication module is further adapted to be communicatively coupled to the data bus;

the communication module is further adapted to receive the appliance messages by receiving the appliance messages from the data bus.

25. The system of claim 18, wherein:

the appliance-specific data includes instructions for controlling the components of the appliance;

the IoT platform is further adapted to select the instructions based on the identity of the appliance; and the communication module is further adapted to: store the instructions in a non-transitory memory, and generate the appliance commands by processing the instructions.

26. The system of claim 18, wherein:

at least one of the communication module, the IoT platform, and a microcontroller of the appliance is capable of determining that a selected function for a received command is a potentially harmful operation of the appliance and deleting the command.

* * * * *